US012129148B2

(12) United States Patent
Watkins et al.

(10) Patent No.: US 12,129,148 B2
(45) Date of Patent: Oct. 29, 2024

(54) DURABLE TRANSFER ROLL CORE AND METHOD OF MAKING AND USING THE SAME

(71) Applicant: The Procter & Gamble Company, Cincinnati, OH (US)

(72) Inventors: Eric James Watkins, Lawrenceburg, IN (US); Gustav André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 614 days.

(21) Appl. No.: 17/320,599

(22) Filed: May 14, 2021

(65) Prior Publication Data

US 2021/0354952 A1 Nov. 18, 2021

Related U.S. Application Data

(60) Provisional application No. 63/025,455, filed on May 15, 2020.

(51) Int. Cl.

| | |
|---|---|
| ***D21H 27/02*** | (2006.01) |
| ***B65H 75/10*** | (2006.01) |
| ***B65H 75/26*** | (2006.01) |
| ***B65H 75/50*** | (2006.01) |
| ***D21H 27/00*** | (2006.01) |

(52) U.S. Cl.

CPC ..... *B65H 75/50* (2013.01); *B65H 75/10* (2013.01); *B65H 75/265* (2013.01); *D21H 27/002* (2013.01); *B65H 2511/11* (2013.01); *B65H 2511/12* (2013.01); *B65H 2511/14* (2013.01); *B65H 2511/15* (2013.01); *B65H 2511/21* (2013.01); *B65H 2701/51* (2013.01)

(58) Field of Classification Search

CPC ..... D21H 27/002
USPC ..... 264/400
See application file for complete search history.

(56) References Cited

U.S. PATENT DOCUMENTS

| | | | | |
|---|---|---|---|---|
| 2,948,203 | A | 8/1960 | Hadley et al. | |
| 3,034,743 | A | 5/1962 | Holmes | |
| 3,405,855 | A * | 10/1968 | Daly | D21F 1/36 226/193 |
| 3,864,182 | A | 2/1975 | Shobert | |
| 4,056,240 | A | 11/1977 | Gallini et al. | |
| 4,462,556 | A | 7/1984 | Graham, Jr. | |
| 4,877,196 | A | 10/1989 | Heymanns | |
| 5,071,083 | A | 12/1991 | Tubota et al. | |
| 5,252,369 | A | 10/1993 | Akao et al. | |
| 6,668,473 | B2 | 12/2003 | Schoening | |
| 7,234,471 | B2 | 6/2007 | Fitzgerald et al. | |
| 9,731,440 | B2 | 8/2017 | Honma et al. | |
| 2006/0112556 | A1 * | 6/2006 | Nakamura | F16L 7/00 29/890.14 |

(Continued)

OTHER PUBLICATIONS

All Office Actions, U.S. Appl. No. 17/320,581.
Unpublished U.S. Appl. No. 17/320,581, filed May 14, 2021, to Watkins Eric James et. al.

*Primary Examiner* — Jacob T Minskey
(74) *Attorney, Agent, or Firm* — Richard L. Alexander

(57) ABSTRACT

A method of grooving a durable transfer roll core may comprising loading the durable transfer roll core onto a grooving apparatus and grooving a main surface of the durable transfer roll core via engagement with one or a plurality of cutting tools of the tooling section of the grooving apparatus.

17 Claims, 15 Drawing Sheets

(56) References Cited

U.S. PATENT DOCUMENTS

| | | | |
|---|---|---|---|
| 2012/0171440 | A1 | 7/2012 | Desai et al. |
| 2014/0084102 | A1 | 3/2014 | Techlin |
| 2020/0055683 | A1 | 2/2020 | Yamaguchi |
| 2020/0095082 | A1 | 3/2020 | Schomber, Jr. |

* cited by examiner

DURABLE TRANSFER ROLL CORE AND METHOD OF MAKING AND USING THE SAME

CROSS REFERENCE TO RELATED APPLICATION

This application claims the benefit of U.S. Provisional Application No. 63/025,455, filed May 15, 2020, the substance of which is incorporated herein by reference.

FIELD OF THE INVENTION

The present disclosure relates to durable transfer roll cores used for making rolled fibrous products.

BACKGROUND OF THE INVENTION

As part of the converting process for making rolled products, rolled absorbent products, and rolled fibrous products such as, for example, paper towels and toilet tissue, a fibrous web may be wound to a transfer roll core to form a transfer roll (also referred to as a parent roll) that allows the manufacturer to store the fibrous web or transport the fibrous web around the manufacturing plant for further converting of the fibrous web. Traditionally, transfer roll cores are made from laminated paper. These paper cores wear out and delaminate from the ordinary converting process—such as from cleaning them (e.g., scraping and scrubbing glue from them) between uses, from being dropped to the floor, etc. Failures of paper cores are expensive and dangerous to the operators of the process of winding and unwinding them because paper cores will sometimes fracture into pieces that release from the transfer roll as it is rotating. Further, these transfer rolls weigh typically weigh 1 to 2 metric tons, which can result in a dangerously unstable transfer roll for the operators to manage. Beyond the safety issues, the fibrous sheet wound about the faulty paper transfer roll core must start the paper making process over (e.g., as broke) or, in some cases, wasted.

The normal life of a paper transfer roll core is about 16-18 transfers (each transfer accounting for 1 wind and 1 unwind of the transfer roll). Because these paper rolls are expensive, this is a costly part of manufacturing rolled paper products. Further, there is limited ability to recycle paper cores that have failed or have worn out because of the amount of glue used to create them, which turns disposal of them into another cost for the manufacturer.

In light of these points, there is a need for a more stable and durable transfer roll core. Particularly, there is a need for a durable transfer roll core that is not subject to failure under all the stresses a transfer roll core is exposed to. There is also a need for a durable transfer roll core that will last longer than traditional transfer roll cores and that can ideally be recycled.

SUMMARY OF THE INVENTION

In a first aspect, a durable transfer roll core may comprise an elongate body comprising a groove, and the elongate body having a longitudinal axis. The groove may comprise a Groove Angle from about 0 to about 85 degrees, relative to the longitudinal axis. The groove may have a Groove Depth greater than about 0.003 inches.

In another aspect, a durable transfer roll core may comprise an elongate body comprising a groove and a ridge, and the elongate body having a longitudinal axis. The groove and the ridge may form a same pattern type.

In another aspect, a durable transfer roll core may comprise an elongate body comprising a groove, and the elongate body having a longitudinal axis. The groove may comprise a Groove Angle from about 0 to about 85 degrees, relative to the longitudinal axis. The groove may have a a Groove Width greater than about 0.01 inches.

In another aspect, a method of winding a durable transfer roll core may comprise the steps of:

(a) feeding a web onto the durable transfer roll core, the durable transfer roll core comprising an elongate body comprising a groove, where the groove comprises a Groove Angle from about 15 to about 90°; and (b) winding the web completely around the body of the durable transfer roll core.

In another aspect, a method of grooving a durable transfer roll core may comprise the steps of:

(a) loading the durable transfer roll core onto a grooving apparatus; and (b) pulling or pushing the durable transfer roll core through the tooling section of the grooving apparatus such that a main surface of the durable transfer roll core is grooved via engagement with one or a plurality of cutting tools of the tooling section of the grooving apparatus.

In another aspect, a method of grooving a durable transfer roll core may comprise the steps of:

(a) surrounding the durable transfer roll core with a grooving apparatus; and (b) moving the grooving apparatus around and/or along the durable transfer roll core such that a main surface of the durable transfer roll core is grooved via engagement with one or a plurality of cutting tools of the tooling section of the grooving apparatus.

In another aspect, a durable transfer roll core may comprise an elongate body comprising a groove, and the elongate body having a longitudinal axis. The durable transfer roll core may have a Core Material Tensile Strength greater than about 1000 $lbf/in^2$ (PSI) and an Izod Impact Strength greater than about 1 ft-lbf/in.

DETAILED DESCRIPTION OF THE INVENTION

Figure 1:
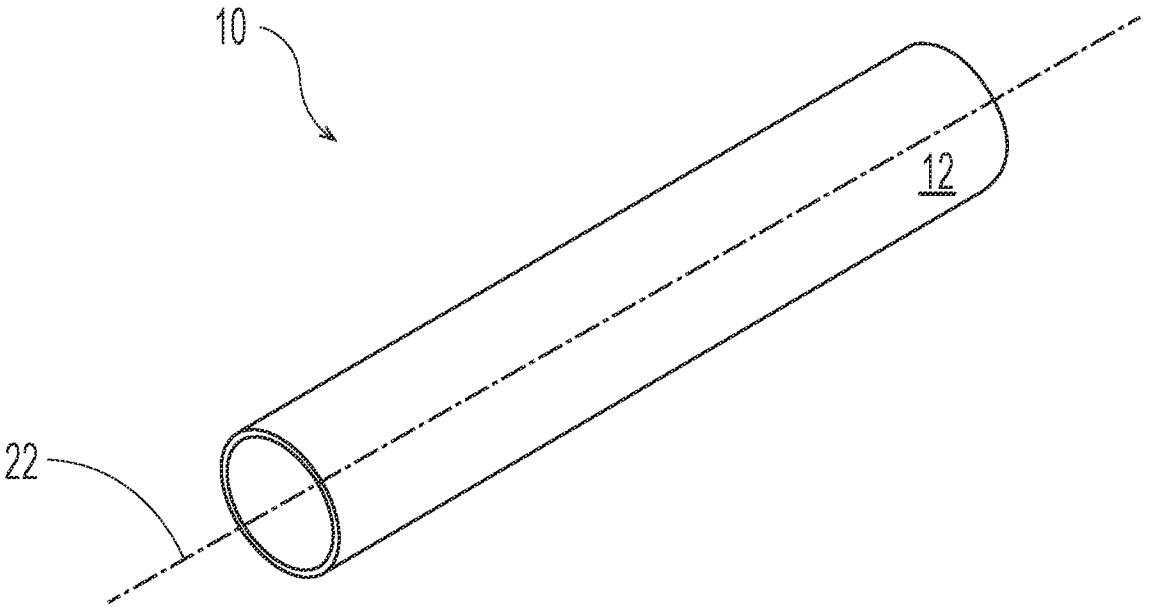
FIG. 1 is a perspective view of a durable transfer roll core.

The following term explanations may be useful in understanding the present disclosure:

"Fibrous structure or fibrous web" as used herein means a structure (web) that comprises one or more fibers. Non-limiting examples of processes for making fibrous structures include known wet-laid fibrous structure making processes, air-laid fibrous structure making processes, meltblowing fibrous structure making processes, co-forming fibrous structure making processes, and spunbond fibrous structure making processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. The fibrous structure may be a through-air-dried fibrous structure and/or conventionally dried fibrous structure. The fibrous structure may be creped or uncreped. The fibrous structure may exhibit differential density regions or may be substantially uniform in density. The fibrous structure may be pattern densified, conventionally felt-presses and/or high-bulk, uncompacted. The fibrous structures may be homogenous or multilayered in construction.

After and/or concurrently with the forming of the fibrous structure, the fibrous structure may be subjected to physical transformation operations such as embossing, calendering, selfing, printing, folding, softening, ring-rolling, applying additives, such as latex, lotion and softening agents, combining with one or more other plies of fibrous structures, and the like to produce a finished fibrous structure that forms and/or is incorporated into a sanitary tissue product.

Fibrous webs of the present disclosure may be wound onto a durable transfer roll core and may be used to form sanitary tissue products described below and may have the plies, basis weight values, tensile strength values, softness values, absorbency values, lint values, and textures described below.

"Sanitary tissue product" as used herein means a wiping implement for post-urinary and/or post-bowel movement cleaning (referred to as "toilet paper," "toilet tissue," or "toilet tissue product"), for otorhinolaryngological discharges (referred to as "facial tissue" or "facial tissue product") and/or multi-functional absorbent and cleaning uses (referred to as "paper towels," "paper towel products," "absorbent towels," "absorbent towel products," such as paper towel or "wipe products").

The sanitary tissue products of the present disclosure may comprise one or more fibrous structures and/or finished fibrous structures.

The sanitary tissue products of the present disclosure may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present disclosure may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$.

The sanitary tissue products of the present disclosure may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in). In addition, the sanitary tissue product of the present disclosure may exhibit a total dry tensile strength of greater than about 196 g/cm (500 g/in) and/or from about 196 g/cm (500 g/in) to about 394 g/cm (1000 g/in) and/or from about 216 g/cm (550 g/in) to about 335 g/cm (850 g/in) and/or from about 236 g/cm (600 g/in) to about 315 g/cm (800 g/in). In one example, the sanitary tissue product exhibits a total dry tensile strength of less than about 394 g/cm (1000 g/in) and/or less than about 335 g/cm (850 g/in). Two or more sanitary tissue products within an array of sanitary tissue products according to the present disclosure may exhibit different total dry tensile strengths.

In one example, one sanitary tissue product in an array of sanitary tissue products according to the present disclosure exhibits a total dry tensile strength of greater than 216 g/cm (550 g/in) and another sanitary tissue product within the array exhibits a total dry tensile strength of less than 216 g/cm (550 g/in).

In another example, the sanitary tissue products of the present disclosure may exhibit a total dry tensile strength of greater than about 315 g/cm (800 g/in) and/or greater than about 354 g/cm (900 g/in) and/or greater than about 394 g/cm (1000 g/in) and/or from about 315 g/cm (800 g/in) to about 1968 g/cm (5000 g/in) and/or from about 354 g/cm (900 g/in) to about 1181 g/cm (3000 g/in) and/or from about 354 g/cm (900 g/in) to about 984 g/cm (2500 g/in) and/or from about 394 g/cm (1000 g/in) to about 787 g/cm (2000 g/in).

The sanitary tissue products of the present disclosure may exhibit a total wet tensile strength of less than about 78 g/cm (200 g/in) and/or less than about 59 g/cm (150 g/in) and/or less than about 39 g/cm (100 g/in) and/or less than about 29 g/cm (75 g/in).

The sanitary tissue products of the present disclosure may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

The sanitary tissue products of the present disclosure may be in any suitable form, such as in a roll, in individual sheets, in connected, but perforated sheets, in a folded format or even in an unfolded.

The sanitary tissue products of the present disclosure may comprise additives such as softening agents, temporary wet strength agents, permanent wet strength agents, bulk softening agents, lotions, silicones, and other types of additives suitable for inclusion in and/or on sanitary tissue products. In one example, the sanitary tissue product, for example a toilet tissue product, comprises a temporary wet strength resin. In another example, the sanitary tissue product, for example an absorbent towel product, comprises a permanent wet strength resin.

"Ply" or "plies" as used herein means an individual finished fibrous structure optionally to be disposed in a substantially contiguous, face-to-face relationship with other plies, forming a multiple ply ("multi-ply") sanitary tissue product. It is also contemplated that a single-ply sanitary tissue product can effectively form two "plies" or multiple "plies", for example, by being folded on itself.

"Basis Weight" as used herein is the weight per unit area of a sample reported in lbs/3000 $ft^2$ or $g/m^2$. The basis weight is measured herein by the basis weight test method described in the Test Methods section herein.

"Dry Tensile Strength" (or simply "Tensile Strength" as used herein) of a fibrous structure of the present disclosure and/or a sanitary tissue product comprising such fibrous structure is measured according to the Tensile Strength Test Method described herein.

"Softness" as used herein means the softness of a fibrous structure according to the present disclosure and/or a sanitary tissue product comprising such fibrous structure, which is determined according to a human panel evaluation wherein the softness of a test product is measured versus the softness of a control or standard product. The resulting number is a relative measure of softness between the two fibrous structures and/or sanitary tissue products. The softness is measured herein by the softness test method described in the Test Methods section herein.

"Absorbency" as used herein means the characteristic of a fibrous structure according to the present disclosure and/or a sanitary tissue product comprising such fibrous structure, which allows it to take up and retain fluids, particularly water and aqueous solutions and suspensions. In evaluating the absorbency of paper, not only is the absolute quantity of fluid a given amount of paper will hold significant, but the rate at which the paper will absorb the fluid is also. Absorbency is measured herein by the Horizontal Full Sheet (HFS) test method described in the Test Methods section herein.

"Lint" as used herein means any material that originated from a fibrous structure according to the present disclosure and/or sanitary tissue product comprising such fibrous structure that remains on a surface after which the fibrous structure and/or sanitary tissue product has come into contact. The lint value of a fibrous structure and/or sanitary tissue product comprising such fibrous structure is determined according to the Lint Test Method described herein.

"Texture" as used herein means any pattern present in the fibrous structure. For example, a pattern may be imparted to the fibrous structure during the fibrous structure-making process, such as during a through-air-drying step. A pattern may also be imparted to the fibrous structure by embossing the finished fibrous structure during the converting process and/or by any other suitable process known in the art.

"Rolled product(s)" as used herein include fibrous structures, paper, and sanitary tissue products that are in the form of a web and can be wound about a core. For example, rolled sanitary tissue products can be convolutedly wound upon itself about a core or without a core to form a sanitary tissue product roll and can be perforated into the form of discrete sheets, as is commonly known for toilet tissue and paper towels.

Durable Transfer Roll Core

Figure 3:
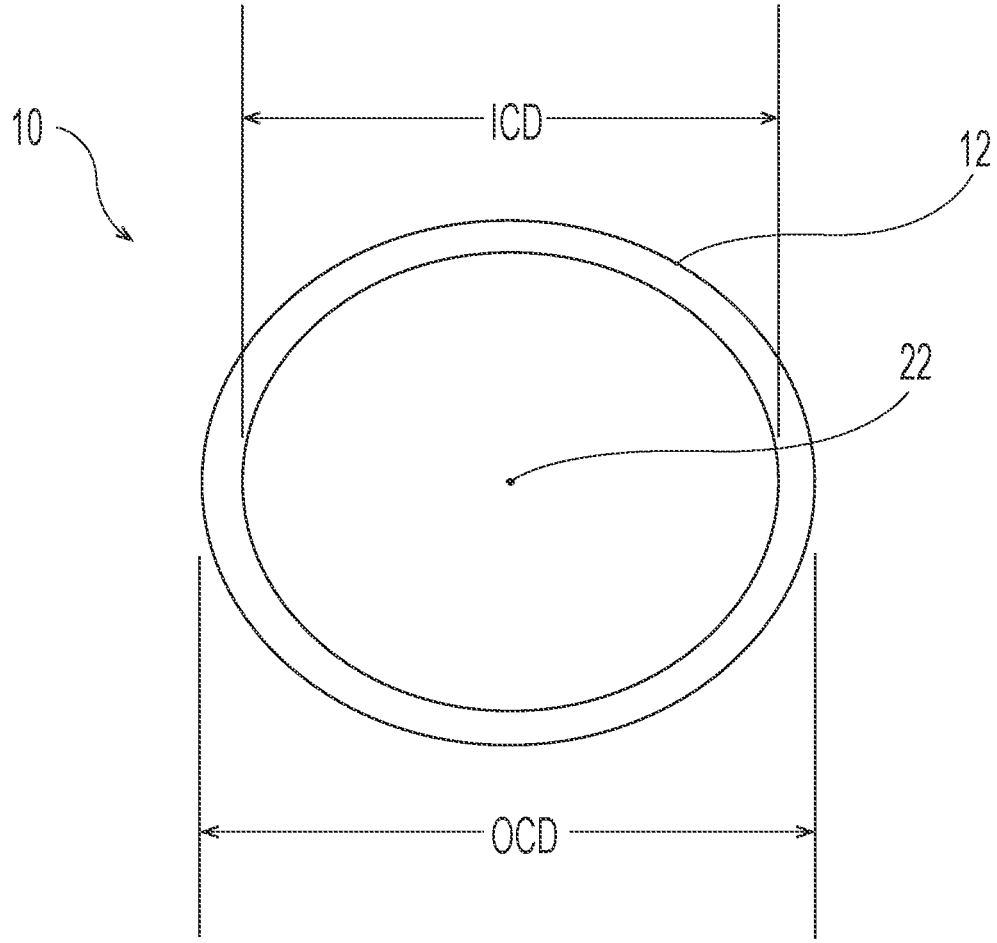
FIG. 3 is a side view of the durable transfer roll core of FIG. 1.
Figure 4:
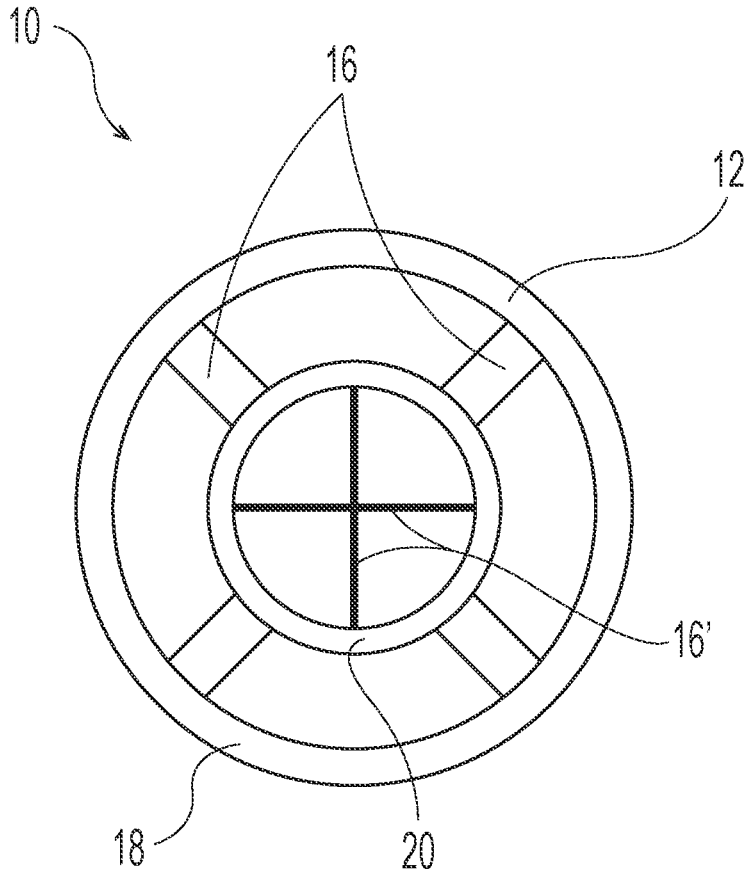
FIG. 4 is a side view of a durable transfer roll core comprising an inner tube and ribs.

Referring to FIG. 1, a durable transfer roll core 10 may comprise an elongate body 12 having a longitudinal axis 22. The elongate body 12 may be solid or hollow (see FIG. 3). As shown in FIGS. 5A-7, the elongate body 12 may comprise grooves 14. As shown in FIG. 4, if the durable transfer roll core is hollow, it may comprise interior ribs 16 to provide additional strength. Further, as shown in FIG. 4, the durable transfer roll core 10 may comprise an outer tube 18, an inner tube 20 within the outer tube 18, and ribs 16 connecting the inner and outer tubes 20 and 18, and optionally, ribs 16' within the inner tube 20.

Figure 2:
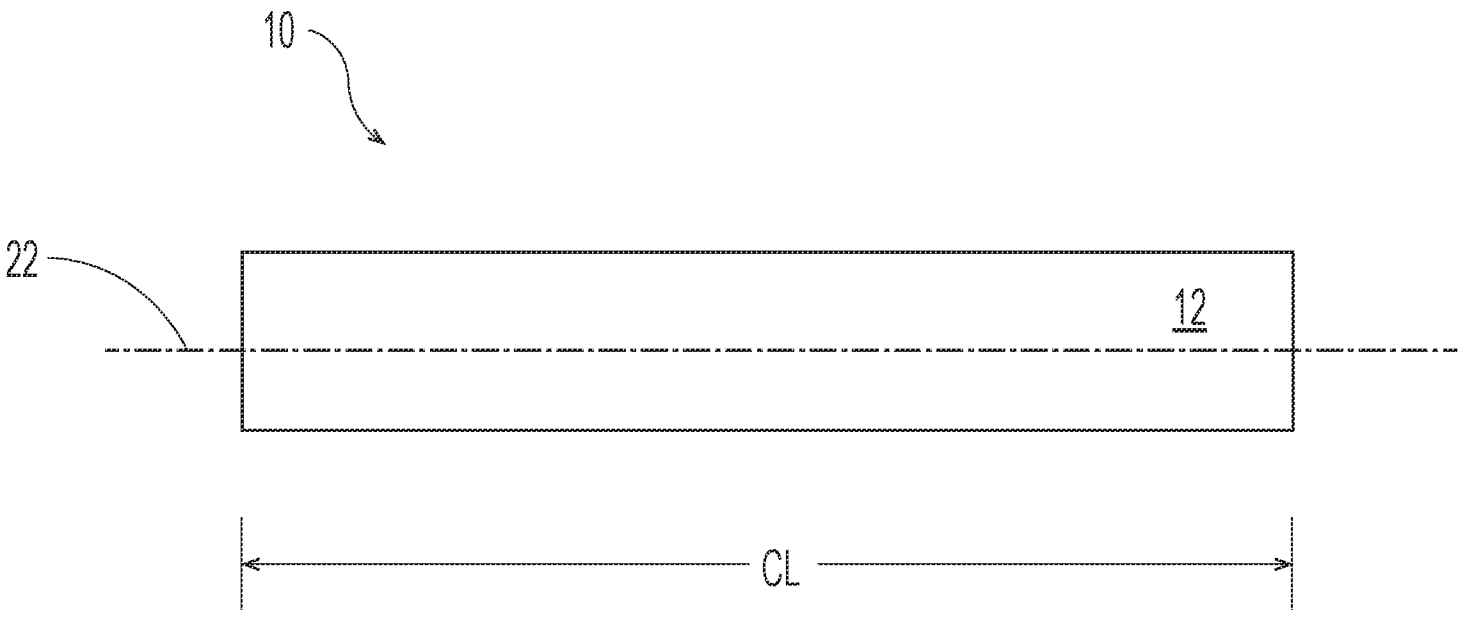
FIG. 2 is a front view of the durable transfer roll core of FIG. 1.

The durable transfer roll core 10 may have a Core Length (distance CL—see FIG. 2) from about 20 to about 110 inches, from about 85 to about 105 inches, from about 90 to about 103 inches, from about 95-102 inches, or from about 97 to about 101 inches, specifically reciting all 0.25 inch increments within the above-recited ranges and all ranges formed therein or thereby (and may vary based on width of the fibrous web 30 being made, if the transfer roll will be turned into narrower transfer rolls (chips) as part of the transfer process, or based on manufacturing equipment differences); and may have an Outer Core Diameter (distance OCD—see FIG. 3) from about 10 to about 19 inches, from about 11-17.5 inches, from about 11.5 to about 16 inches, or from about 12 to about 15 inches, specifically reciting all 0.25 inch increments within the above-recited ranges and all ranges formed therein or thereby (and may vary based on manufacturing equipment differences); and an Inner Core Diameter (distance ICD—see FIG. 3) from about 9-18 inches, from about 10.5 to about 16.25 inches, from about 11 to about 15 inches, or from about 12 to about 14 inches, specifically reciting all 0.25 inch increments within the above-recited ranges and all ranges formed therein or thereby (and may vary based on manufacturing equipment differences). The distance between the OCD and ICD may be referred to as the durable transfer roll core's "wall thickness," which may be from about 2 to about 0.25 inches, from about 1.75 to about 0.75 inches, from about 1.5 to about 1 inch, or from about 1.25 to about 1 inch, specifically reciting all 0.05 inch increments within the above-recited ranges and all ranges formed therein or thereby.

The durable transfer roll core 10 may weigh from about 5-120 lbs, from about 20-105 lbs, or from about 35-90 lbs, specifically reciting all 1 lb increments within the above-recited ranges and all ranges formed therein or thereby. A traditional paper laminate roll may weigh about 35-95 lbs. Thus, a durable transfer roll core 10 may be lighter than a traditional paper laminate roll, which is may be a safety advantage of using a durable transfer roll core. The durable transfer roll core 10 may, in cross-section, be cylindrical, oval, or may be a polygon.

Figure 5B:
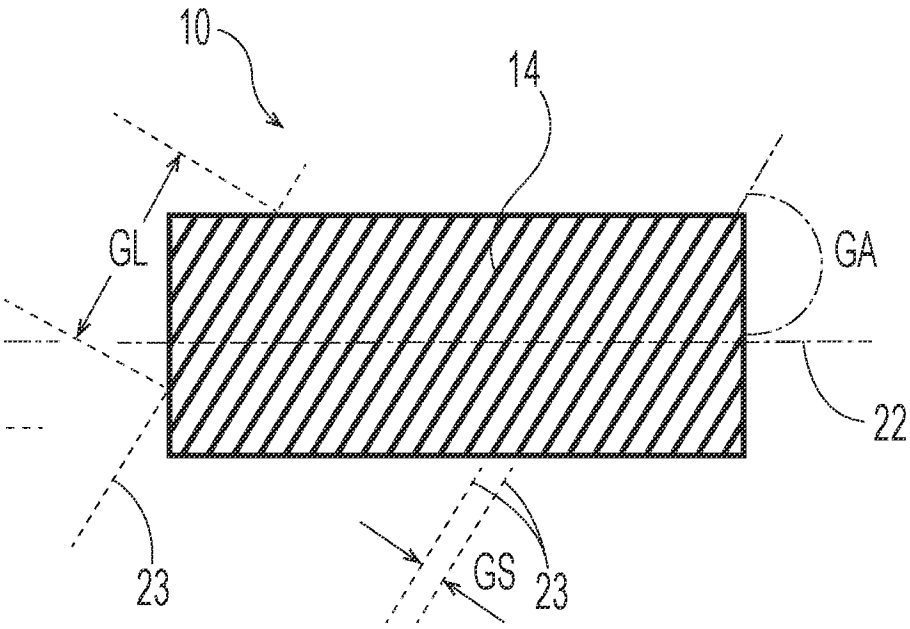
FIG. 5B is a front view of a durable transfer roll core comprising a pattern of grooves.
Figure 5A:
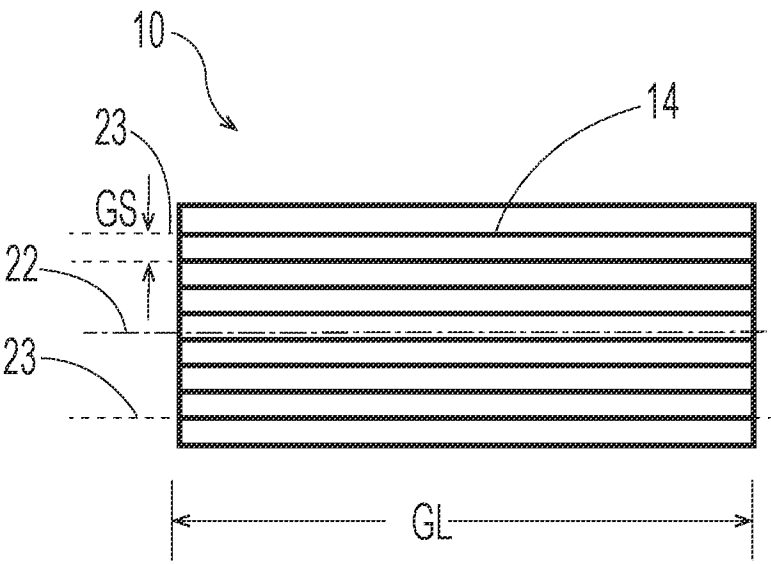
FIG. 5A is a front view of a durable transfer roll core comprising a pattern of grooves.
Figure 5D:
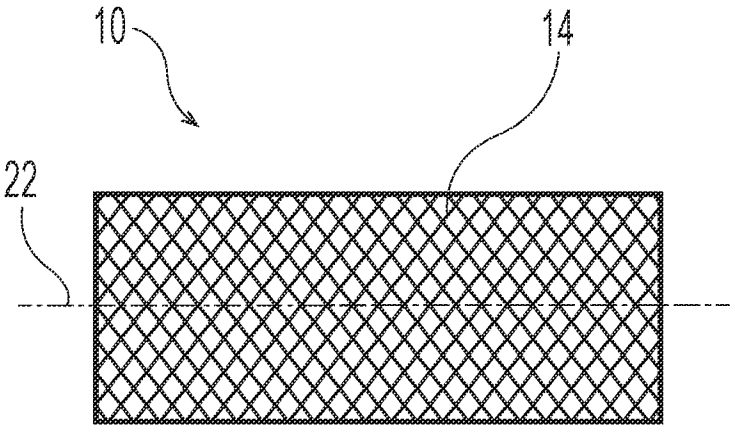
FIG. 5D is a front view of a durable transfer roll core comprising a pattern of grooves.
Figure 5C:
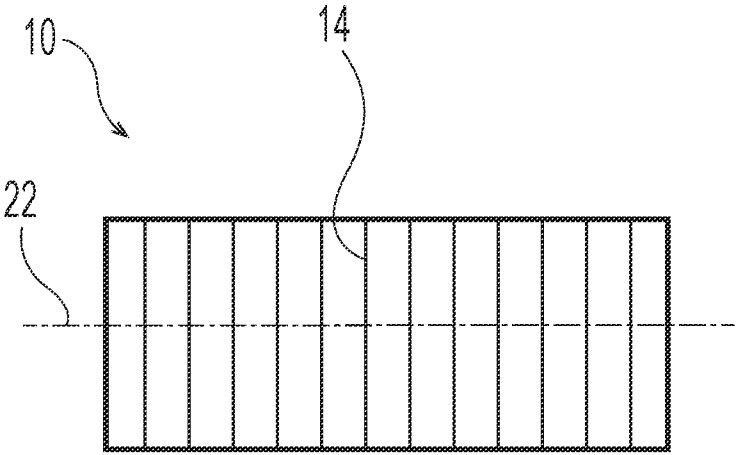
FIG. 5C is a front view of a durable transfer roll core comprising a pattern of grooves.
Figure 5F:
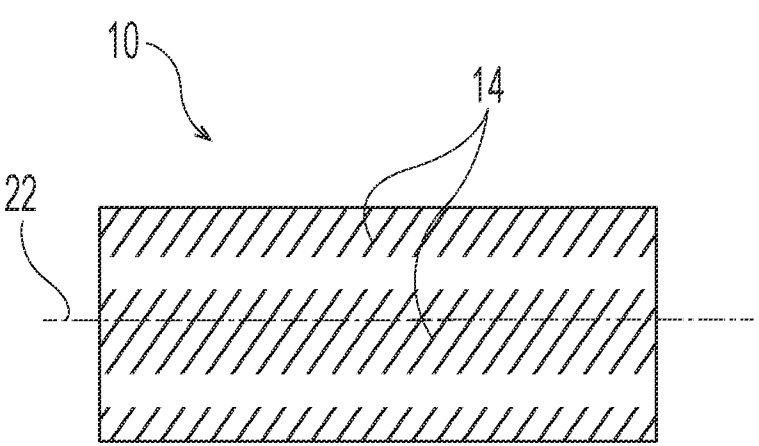
FIG. 5F is a front view of a durable transfer roll core comprising a pattern of grooves.
Figure 5E:
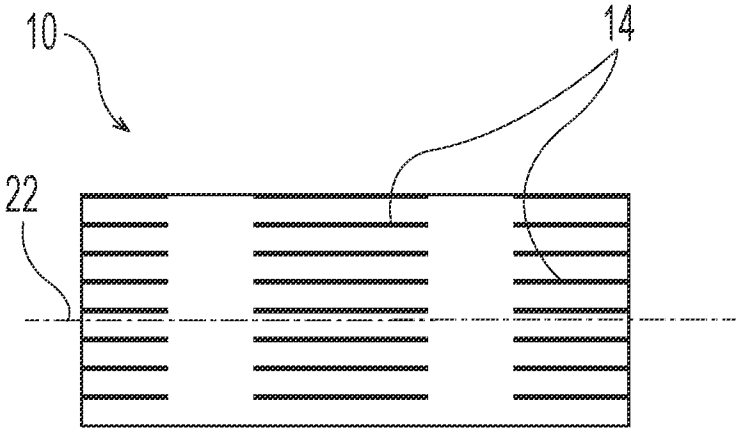
FIG. 5E is a front view of a durable transfer roll core comprising a pattern of grooves.
Figure 5H:
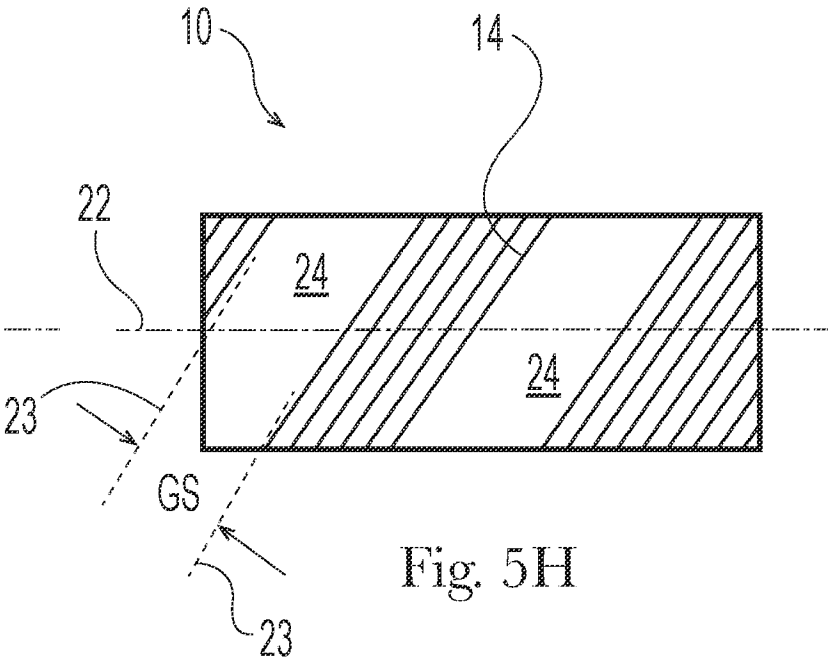
FIG. 5H is a front view of a durable transfer roll core comprising a pattern of grooves.
Figure 5G:
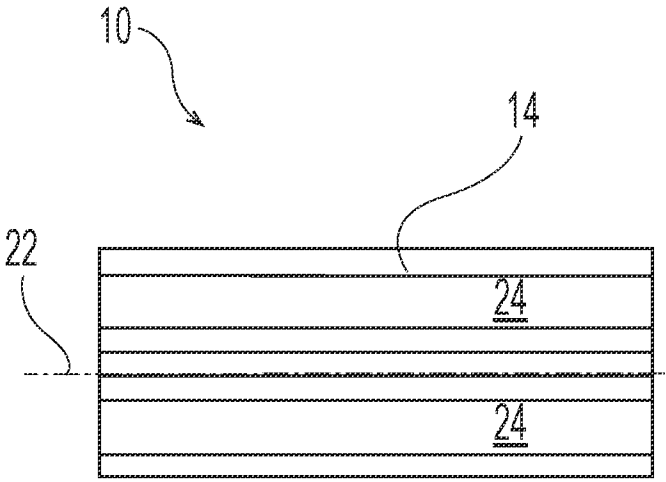
FIG. 5G is a front view of a durable transfer roll core comprising a pattern of grooves.

The grooves 14 may be continuous (see FIGS. 5A-D) or non-continuous (see, for example, FIGS. 5E and F forming groove segments). The grooves 14 may run along the length of the durable transfer roll core. The grooves 14 may be in various patterns, including axial linear (see FIG. 5A), spiral (see FIG. 5B), radial linear (see FIG. 5C), knurled (see FIG. 5D), diamond, double spiral, etc. The grooves 14 may have a Groove Angle (angle GA relative to the longitudinal axis of the durable transfer roll core—see FIG. 5B) from about 0 to about 90 degrees, from about 1 to about 89 degrees, from about 10 to about 75 degrees, from about 15 to about 60 degrees, from about 20 to about 55 degrees, or from about 25 to about 50 degrees, specifically reciting all 5 degree increments within the above-recited ranges and all ranges formed therein or thereby.

Figure 6C:
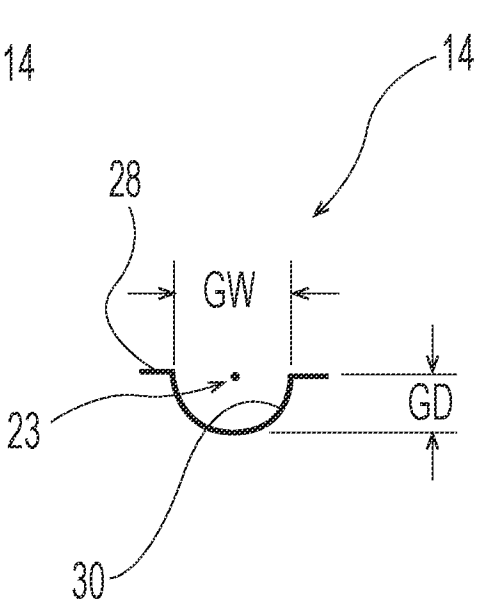
FIG. 6C is a cross-sectional view a groove of the present disclosure.
Figure 6B:
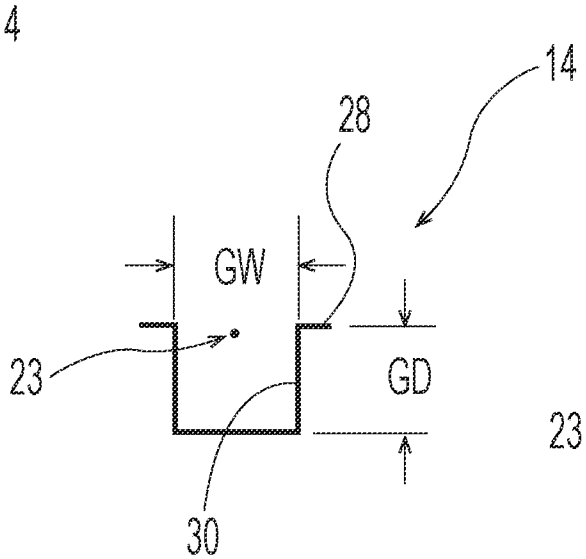
FIG. 6B is a cross-sectional view of a groove of the present disclosure.
Figure 6A:
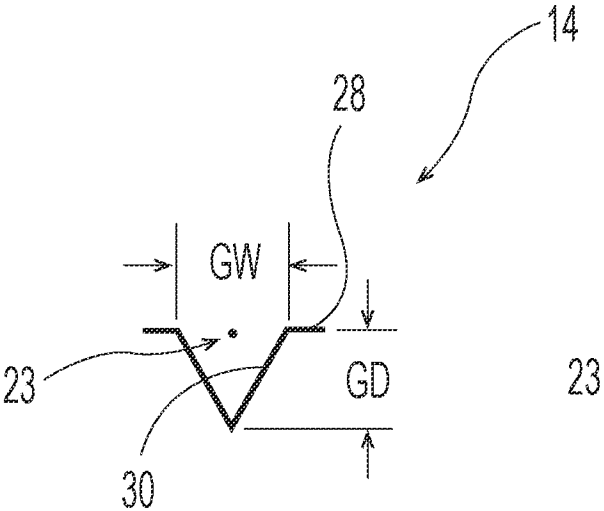
FIG. 6A is a cross-sectional view of a groove of the present disclosure.

As shown in FIGS. 6A-C, the grooves 14 may be various shapes, including, but not limited to V-shaped (see FIG. 6A), square-shaped (see FIG. 6B), U-shaped (see FIG. 6C), etc. Further, the grooves may have a Groove Depth (distance GD—see FIGS. 6A-7) from about 0.003 to 0.1 inches, from about 0.005 to about 0.06 inches, from about 0.007 to about 0.04 inches, or from about 0.01 to 0.03 inches, specifically reciting all 0.001 inch increments within the above-recited ranges and all ranges formed therein or thereby.

Further, the grooves 14 may comprise a Groove Length (distance GL—see FIGS. 5A and B) from about 1 to about 112 inches, from about 10 to about 110 inches, from about 15 to about 100 inches, from about 20 to about 90 inches, from about 25 to about 80 inches, from about 30 to about 70 inches, from about 35-60 inches, or from about 40 to about 55 inches, specifically reciting all 1 inch increments within the above-recited ranges and all range formed therein or thereby; and may comprise a Groove Width (distance GW—see FIGS. 6A-C) from about 0.01 to about 0.3 inches, from about 0.02 to about 0.1 inches, or from about 0.03 to about 0.05 inches, specifically reciting all 0.01 inch increments within the above-recited ranges and all ranges formed therein or thereby. It may be desirable that GW is greater than GD.

Grooves 14 may be spaced from each other (from a groove longitudinal axis 23 to an adjacent groove longitudinal axis 23 relative to a top or side view of the durable transfer roll core 10) such that they have a Groove Spacing (distance GS—see FIGS. 5A, B, and H) from about 0.05 to about 60 inches, from about 0.1 to about 15 inches, from about 0.25 to about 5 inches, or from about 0.5 to about 2.0 inches, specifically reciting all 0.05 inch increments within the above-recited ranges and all ranges formed therein or thereby. Ridge Spacing (distance RS—see FIG. 7) may be the same distances disclosed above for Groove Spacing.

While the durable transfer roll core 10 may comprise grooves 14 and/or ridges 26, it may also have groove/ridge free zones 24, where the main surface 28 is free of grooves 14 or ridges 26. More particularly, a groove/ridge free zone 24 may be an area without grooves 14 or ridges 26 as compared to a surface area that has multiple grooves 14 and/or ridges 26 over the same or equal surface area.

The durable transfer roll core 10 may be made from plastic, thermoplastic, metal, carbon filaments, thermoplastic resins, and combinations thereof. This allows the durable transfer roll core 10 to be recyclable. When made from high density polyethylene (HDPE), it may be melted down and reformed back into a durable transfer roll core 10. The durable transfer roll cores 10 may also be made from polypropylene random copolymer with modified crystallinity (PP-RCT), polypropylene random copolymer (PP-R), crosslinked polyethylene (PEX), and/or polypropylene.

The durable transfer roll core may comprise multiple groove segments. The groove segments may be staggered from each other (not shown).

The durable transfer roll core may comprise ridges 26 instead of grooves 14 or may comprise ridges 26 in combination with grooves 14. That is, instead of the main surface 28 of the durable transfer roll core 10 comprising grooves 14 within it, a ridge 26 may extend from the main surface 28 (see FIG. 7). Ridges 26 may extend adjacent to and along a groove side wall 30. Ridges 26 and grooves 14 may alternate around the diameter of the durable transfer roll core 10. The ridges 26 may be radiused at a top portion.

And, as the groves 14 may be groove segments, the ridges 26 may be ridge segments. The ridge segments may be aligned with the groove segments. Alternatively, ridge segments may be offset from the groove segments, such that the end edges of the ridge segments and of the groove segments are not aligned. The groove and ridge segments may be from about 0.25-110 inches, from about 0.5-75 inches, from about 1-60 inches, from about 10-50 inches, from about 15-40 inches, or from about 20-30 inches, specifically reciting all 0.25 inch increments within the above-recited ranges and all ranges formed therein or thereby.

Figure 7:
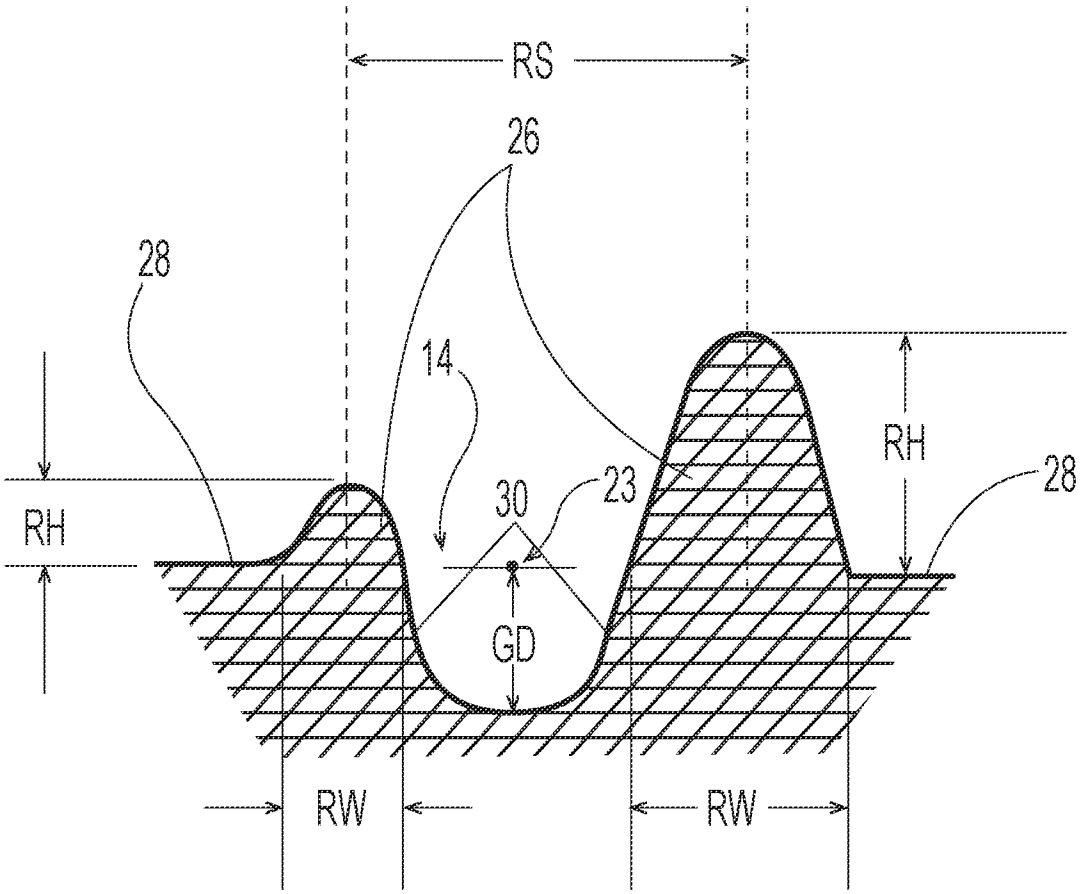
FIG. 7 is a cross-sectional view of a groove and ridges of the present disclosure.
Figure 8:
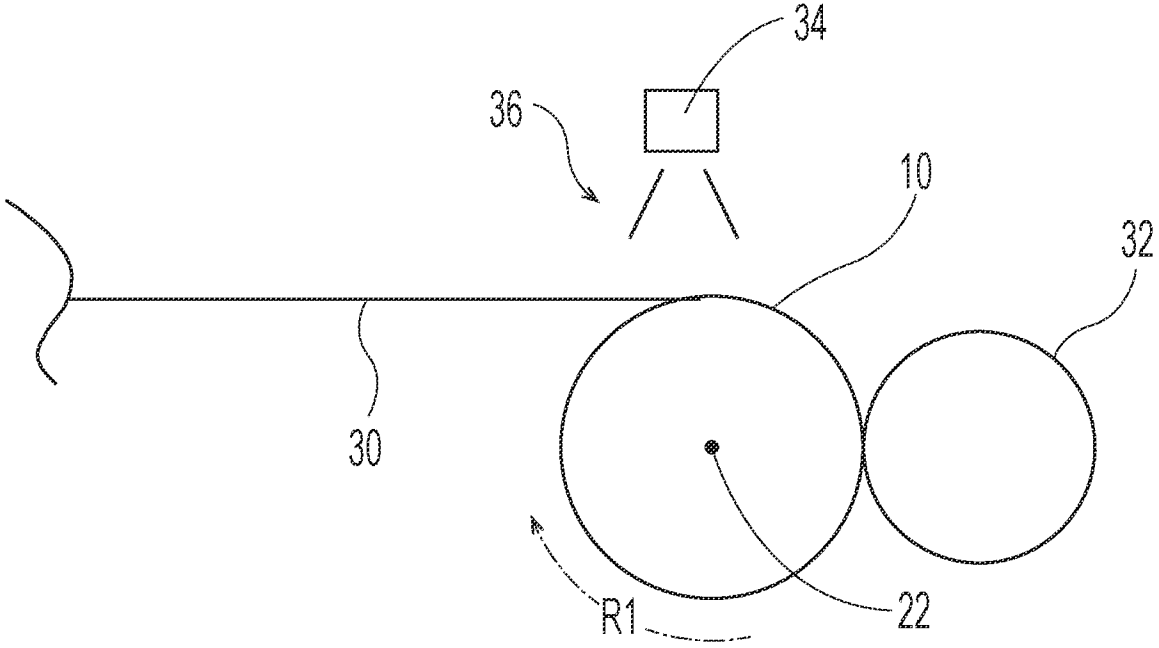
FIG. 8 is a process schematic illustrating a fibrous web being fed onto a durable transfer roll core.

Referring to FIG. 7, a first ridge 26 may be on one side of a groove 14 and a second ridge 26 may be on the opposite side of the groove. The first and second ridges may have the same Ridge Height (distance RH) or the first ridge may have a greater Ridge Height than the second ridge. The first ridge may be about 25%, 50%, or about 75% greater than the height of the second ridge.

Further, ridges 26 may have a Ridge Height (distance RH) from about 0.001 to 0.08 inches, from about 0.003-0.06 inches, from about 0.007-0.04 inches, or from about 0.01 to 0.03 inches, specifically reciting all 0.001 inch increments within the above-recited ranges and all ranges formed therein or thereby.

Further, ridges 26 may comprise a Ridge Length (distance RL) from about 10-112 inches, from about 11-110 inches, from about 15-100 inches, from about 20-90 inches, from about 25-80 inches, from about 30-70 inches, from about 35 to about 60 inches, or from about 40-50 inches, specifically reciting all 1 inch increments within the above-recited ranges and all ranges formed therein or thereby; and may comprise a Ridge Width (distance RW) from about 0.001 to 0.1 inches, from about 0.003-0.08 inches, from about 0.007-0.06 inches, or from about 0.01 to 0.03 inches, specifically reciting all 0.001 inch increments within the above-recited ranges and all ranges formed therein or thereby. It may be desirable that RH is greater than RW.

Ridges 26 may be in the same patterns as described and illustrated (see FIGS. 5A-D) for the grooves above.

Durable transfer roll cores 10 (or, as appropriate, the materials the durable transfer roll cores are made up of) of the present disclosure may have the following specifications:

| Name | Value | Test Method |
|---|---|---|
| Core Material Tensile Strength, breaking, (aka Ultimate Tensile Strength) | ≥1000, ≥2000, ≥3000, ≥4000, from 5000 to 5500 (lbf/in$^2$ (PSI)) | ASTM D638 (Speed of Testing: 2 in/min) |
| Core Delamination Resistance Test | ≥10 drops, ≥20 drops, ≥30 drops, ≥100 drops, >100 drops; without material damage | Drop Test (see Test Method section below) |
| Core Material Elongation at Break | ≥10%, ≥50%, ≥100%, ≥500%, >600% | ASTM D638 (Speed of Testing: 2 in/min) |
| Izod Impact Strength (notched) | ≥1, ≥5, ≥8, ≥9 (ft-lbf/in) | ASTM D256 |

-continued

| Name | Value | Test Method |
|---|---|---|
| Core Material Surface Contact Angle (DI water) | >5, >10, >15, >30, >60, <100 degrees, Clean HDPE (85-95 degrees), Dusty HDPE (60-65 degrees) | Clean HDPE ("Surface modification of HDPE and PP by mechanical polishing and DC glow discharge and their adhesive joining to steel," S. Bhowmik, P. K. Ghosh, S. Ray; J Appl Polym Sci 80; pp 1143, 1140-1149, 2001); Dusty to clean HDPE "Loss of Hydrophobicity of High Density Polyethylene," M. A. Khan and R. Hackam, 1997 IEEE Annual Report-Conference on Electrical Insulation and Dielectric Phenomena, Minneapolis, Oct. 19-22, 1997, pp 378, 378-381. Alpha cellulose (26 to 0 deg in seconds) and HWK (43 deg to 0 in seconds) "Contact angle of water on paper components: sessile drops versus environmental scanning electron microscope measurements," A. Liukkonen, SCANNING, Vol. 19, 411-415, 1997. See also ASTM D7334 |
| Cut resistance | | No method, uses without delaminating or damage that would take out of service |

Material(s) used to form the above durable transfer roll cores 10 of the present disclosure may have: a Core Material Tensile Strength from about 1,000 to about 6,000 lbf/in$^2$ (PSI), from about 2,000 to about 5,000 lbf/in$^2$ (PSI), or from about 3,000 to about 4,000 lbf/in$^2$ (PSI), specifically reciting all 1 lbf/in$^2$ (PSI) increments within the above-recited ranges and all ranges formed therein or thereby; and/or may have a Core Material Elongation at Break from about 10 to about 600%, from about 20 to about 500%, from about 50 to about 400%, from about 100 to about 300%, or from about 150 to about 200%, specifically reciting all 1% increments within the above-recited ranges and all ranges formed therein or thereby; and/or an Izod Impact Strength (notched) of from about 1 to about 9 ft-lbf/in, from about 2 to about 8 ft-lbf/in, from about 3 to about 7 ft-lbf/in, or from about 4 to about 6 ft-lbf/in, specifically reciting all 0.5 ft-lbf/in, increments within the above-recited ranges and all ranges formed therein or thereby; and/or a Core Material Surface Contact Angle (DI water) from about 5 to about 100 degrees, from about 10 to about 90 degrees, from about 20 to about 80 degrees, from about 30 to about 60 degrees, or from about 40 to about 50 degrees, specifically reciting all 1 degree increments within the above-recited ranges and all ranges formed therein or thereby.

Further regarding the Drop Test, inventive durable transfer cores may have the following results vs a comparative traditional paper laminate roll core:

| Core material | Total # of drops | Average ID damage % change | Absolute Ratio of OD/ID damage ratio | Average OD Lip axial depth damage (inches) | Average ID Lip axial depth damage (inches) | Fraction of circumference with axial ID lip damage fraction | Special Damage |
|---|---|---|---|---|---|---|---|
| Traditional paper laminate (comparative) | 40 | −16.7% | 0.08 | 0.30 | 0.36 | 1.0 | Severe delamination |
| High density polyethlene (inventive) | 100 | −0.6% | 1.95 | 0.13 | 0.04 | 0.1 to 0.8 | None observed |
| Polypropylene (inventive) | 100 | −0.3% | 3.01 | 0.12 | 0.03 | <0.2 | None observed |
| acrylonitile butadiene styrene (inventive) | 100 | −1.2% | 0.89 | 0.09 | 0.01 | <0.1 | Inclusion/internal delamination (multiple) |
| Acrylonitile butadiene styrene (inventive) | 100 | −0.3% | 4.99 | 0.15 | 0.03 | <0.1 | Buckling on ID wall (multiple) |
| Polypropylene random copolymer high crystalinity (inventive) | 100 | −0.3% | 3.40 | 0.10 | 0.02 | <0.05 | |

*ID = Inner diameter; OD = Outer diameter

Further regarding the Drop Test, durable transfer roll cores 10 of the present disclosure may have a Core Delamination Resistance from about 10 to about 100 drops, from about 20 to about 90 drops, from about 30 to about 80 drops, from about 40 to about 70 drops, from about 50 to about 60 drops without delamination.

Durable Transfer Roll Core Examples

The following are example durable transfer roll cores within the scope of the present disclosure:

| | GS (inches) | GD (inches) | GW (inches) | GL (inches) | GA (degrees) | Groove Pattern | CL (inches) | OCD (inches) | ICD (inches) |
|---|---|---|---|---|---|---|---|---|---|
| Inventive Durable Transfer | 0.070 | 0.010 | 0.020 | >10,000 | 45 | Knurled | 101.5 | 11.3 | 10.35 |

-continued

| | | | | | | | | | |
|---|---|---|---|---|---|---|---|---|---|
| Roll Core 1 (continued in the following table) | | | | | | | | | |
| Inventive Durable Transfer Roll Core 2 (continued in the following table) | 0.5 or 1.0 (to confirm) | 0 to 0.050 | 0.060 | >3500 | 87-89 | Spiral | 101.5 | 11.3 | 10.35 |
| Inventive Durable Transfer Roll Core 3 (continued in the follwing table) | 1 | 0 to 0.050 | Up to 0.125 | >105 | 23-26 | Spiral | 102 | 17.05 | 16.05 |

| | RS (inches) | RH (inches) | RW (inches) | RL (inches) | Core Material |
|---|---|---|---|---|---|
| Inventive Durable Transfer Roll Core 1 (continued) | Non-continuous | <0.010 | <0.030 | Varied, not intended to have a ridge but burrs present | HDPE |
| Inventive Durable Transfer Roll Core 2 (continued) | Non-continuous | <0.010 | <0.030 | Varied, not intended to have a ridge but burrs present | HDPE |
| Inventive Durable Transfer Roll Core 3 (continued) | Non-continuous | <0.010 | <0.030 | Varied, not intended to have a ridge but burrs present | HDPE |

Making a Transfer Roll Core

Figure 9:
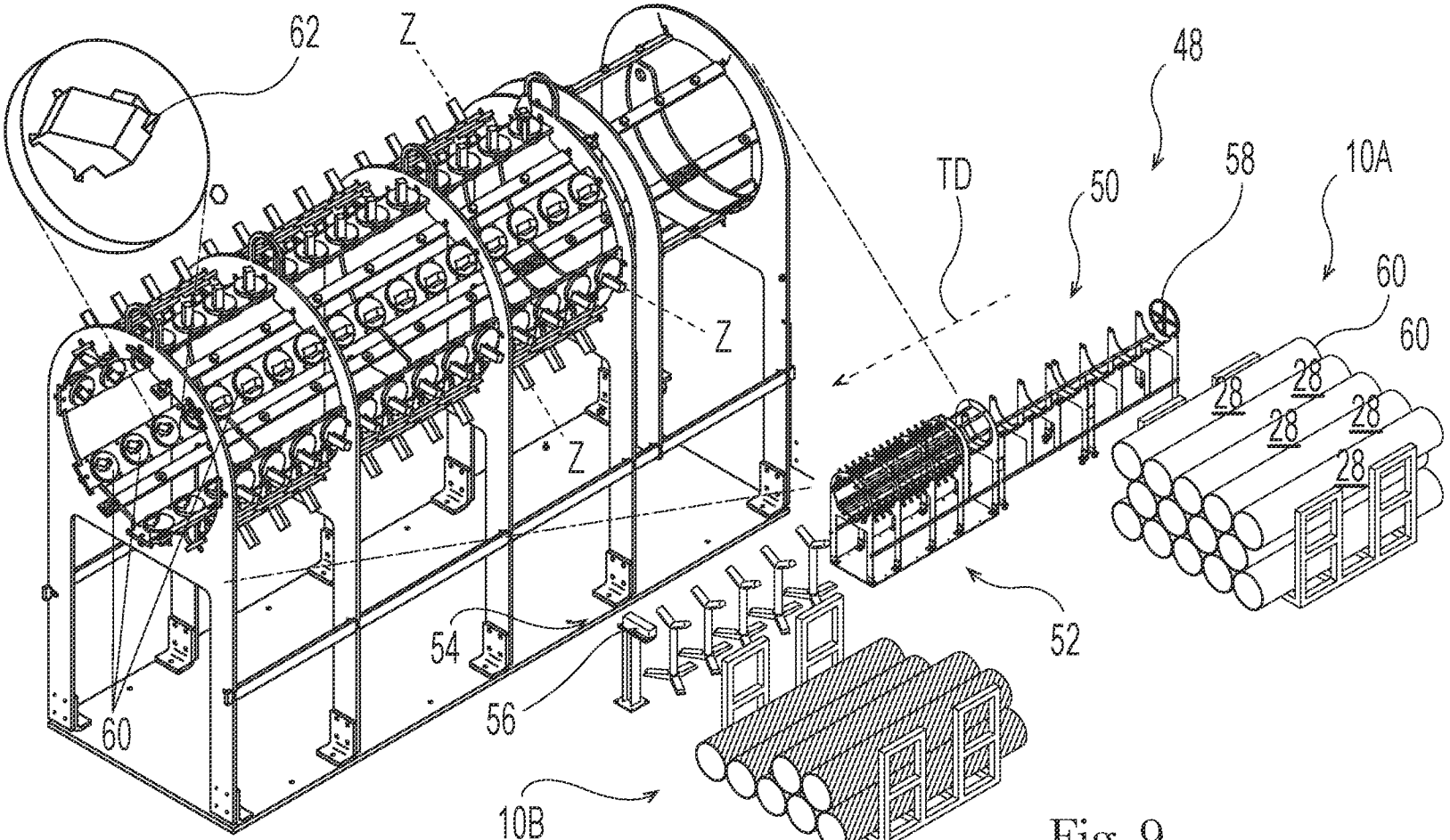
FIG. 9 illustrates a method of and equipment for imparting grooves 14 into the durable transfer roll cores.

Referring to FIG. 9, grooves 14 may be imparted to the durable transfer roll cores 10A that comprise smooth main surfaces 28 by:

Step a): Loading the durable transfer roll core 10A on a loading support section 50 of the grooving apparatus 48.

Step b): Running a cable (or rope, chain, etc.), which is anchored to a winch 56, over an unloading support section 54 of the grooving apparatus 48, through a tooling section 52 of the grooving apparatus 48, and through a hollow center of the durable transfer roll 10A that is resting on the loading support section 50 of the grooving apparatus 48, and attaching the cable to a pulling base 58, such that the pulling base 58 rests against an end edge 60 of the durable transfer roll core 10A and such that the durable transfer roll core 10A is able to be pulled in a tooling direction (direction TD) through the tooling section 52 so that it can be grooved by the tooling section 52. Alternatively, instead of using a winch 56 and cable to pull the durable transfer roll core 10A, the durable transfer roll core 10A may be pushed through the grooving apparatus 48, and particularly pushed through the tooling section 52.

Step c): Using the winch 56 to pull the durable transfer roll core 10A through the tooling section 52 (or alternatively pushing the durable transfer roll core 10A) such that the main surface 28 of the durable transfer roll 10A is grooved via engagement with one or a plurality of cutting tools 60 (such as a cutting tool bit or blade 62 (illustrated in FIG. 9), a rotating tool bit, a knurling tool, a melting tool, a reciprocating or banded saw blade, a rotary saw, laser, etc). The cutting tools 60 may be placed at different positions such that the cutting tools 60 surround multiple points around the durable transfer roll core 10A to achieve the desired groove 14 shape (such as those described above and illustrated in FIGS. 6A-7) and groove 14 pattern (such as those described above and illustrated in FIGS. 5A-H). Ridges 26 (such as those described above and illustrated in FIG. 7) may be formed as part of the groove 14 making process, especially depending on the temperature of the elongate body 12 when forming the grooves, the type of tool used, the sharpness of that tool, the type of material forming the elongate body 12, etc. For instance, ridges 26 may be one or a combination of melt deposits, plowing burrs, and cutting burrs, and may be formed from the material being removed from the main surface 28 to form the groove 14. The durable transfer roll core 10 may or may not rotate about its longitudinal axis 22 as it transitions through the tooling section 52.

While there may be multiple cutting tools 60 arranged about the tooling section 52, not all of the cutting tools 60 may be set for engagement of the main surface 28 of the durable transfer roll core 10A—that is, only certain cutting tools 60 may be positioned in a Z direction for engagement of the main surface 28 to achieve a desired groove pattern (e.g., spiral groove pattern), then, different and/or additional cutting tools 60 may be positioned in a Z direction for engagement of a different groove pattern (e.g., an axial linear groove pattern).

Step d): Unloading the grooved durable transfer roll core 10B.

The grooved durable transfer roll core 10B may then be used in a process for making rolled fibrous products, such feeding a fibrous web 30 onto the grooved durable transfer roll core 10B in a process such as the one described in the Converting Process Using a Durable Transfer Roll Core (below).

Grooves 14 may be imparted to the durable transfer roll core 10 via a cutting tool bit, a rotating tool bit, a knurling tool, a melting tool, a reciprocating or banded saw blade, a rotary saw, or similar machining approaches. Ridges 26 may be formed as part of the groove 14 making process, especially depending on the temperature of the elongate body 12 when forming the grooves, the type of tool used, the sharpness of that tool, the type of material forming the elongate body 12, and the rate and manner of application to the grooving tool, etc. Instead of pushing and/or pulling the durable transfer roll core through the grooving apparatus, the grooving apparatus may move along and/or around the durable transfer roll core. This may be accomplished by surrounding the durable transfer roll core with a grooving apparatus and by moving the grooving apparatus around and/or along the durable transfer roll core such that a main surface of the durable transfer roll core is grooved via engagement with one or a plurality of cutting tools of the tooling section of the grooving apparatus. Further, the durable transfer roll core may be moved linearly through and/or rotated as the grooving apparatus moves around and/or along the durable transfer roll core. Still further, a second grooving apparatus may also be moved around and/or along the durable transfer roll core such that a main surface of the durable transfer roll core is grooved via engagement with one or a plurality of cutting tools of a second tooling section of the second grooving apparatus.

Converting Process Using a Durable Transfer Roll Core

The fibrous web 30 may be fed from a/an reel drum to a durable transfer roll core 10. As explained above, the durable transfer roll core 10 may comprise grooves 14 and/or ridges 26. The grooves 14 and/or ridges 26 may enable the fibrous web 30 to mate with the durable transfer roll core 10. In order to assist with this mating process, one or more water jets 34 may be used to push the fibrous web 30 into the grooves 14 and/or ridges 26 using a concentrated water stream 36, such that as the durable transfer roll core 10 rotates, the fibrous web 30 may wind about the durable transfer roll core 10 when the fibrous web 30 is locked between the space of the grooves 14 and/or ridges 26. Adhesive may alternatively or may also be used with the water jets 34 to assist in the mating process of the fibrous web 30 to the durable transfer roll core 10, but may not be necessary. Adhesive, when used, that are suitable for use in the present disclosure may include hydrolyzed or partially hydrolyzed polyvinylalcohols (PVOH) and may be disposed between an end of the fibrous web and an outer face of the durable transfer roll core. The adhesive(s) may be applied to the fibrous web and/or the face of the durable transfer roll core via spray, tape, brush, tube, and/or hot melt gun.

In this process, the durable transfer roll core 10 may rotate (direction R1) about its longitudinal axis 22 from about 40 rotations/minute to about 1800 rotations/minute, from about 45 rotations/minute to about 1700 rotations/minute, from about 50 rotations/minute to about 1600 rotations/minute, or from about 55 rotations/minute to about 1400 rotations/minute. It may be desirable that the durable transfer roll core 10 rotates to surface speed match the fibrous web speed at the engagement stage to ensure that good mating of the fibrous web 30 takes place, but as a fibrous web is wound on the core at a given speed for the fibrous web, then the transfer roll core may slow down in rotational speed as the diameter of the transfer roll increases. For instance, the durable transfer roll core may rotate from about 200 rotations/minute to about 1800 rotations/minute until the fibrous web 30 is mated with the durable transfer roll core 10 (which may be less than 10 rotations, less than 7 rotations, less than 5 rotations, or less than 3 rotations), then decreases to from about 55 rotations/minute to about 190 rotations/minute for the end of the winding process.

Once the durable transfer roll core 10 is wound with the fibrous web 30, it may be transported to and mounted in an unwind stand part of the converting process, where it is unwound and rewound to form a smaller diameter paper log, which is then cut into discrete rolled products of, for example, sanitary tissue product that have lint, softness, basis weight, tensile strength, absorbency, and/or texture values as disclosed herein.

Once the durable transfer roll core 10 has been unwound, it is prepared for another cycle (i.e., ready to be wound with another fibrous sheet). To clean the durable transfer roll core 10 for another cycle, any residual paper can be removed by a variety of methods, including, but not limited to, cutting with a knife, scraping off, a plow or wedge device, a rotating saw, a water jet or pressure washer, or an air jet or pneumatic means with the paper dropping off under own weight, pulled off, or pushed off. While grooved durable transfer roll cores 10 have more spaces to collect glue and paper debris, surprisingly, no material amount of such build up occurs. The debris that does collect is easily cleaned off. It is thought that the chemical composition of the durable transfer roll core plays a role in its ability to stay clean through the paper making process.

Noise

One of the challenges with using a durable transfer roll core 10 is the noise it may generate as it rotates prior to the fibrous sheet being initially wound about it, as the grooves 14 and/or ridges 20 contact a reel 32. Operating durable transfer roll core 10 may generate twice the decibels versus a traditional laminate transfer roll core. In order to overcome this, the grooves may be angled and/or spaced as described above (see GA and GS). Ridges may have the same angles and/or spacings (see, for example, RS at FIG. 7) as the grooves disclosed herein to decrease the noise.

ASPECTS OF THE DISCLOSURE

The following aspects are provided as examples in accordance with the disclosure herein and are not intended to limit the scope of the disclosure:

Aspect Example Set 1

1. A durable transfer roll core, comprising:
   an elongate body comprising a groove and a ridge, the elongate body having a longitudinal axis; and
   wherein the groove and the ridge form a same pattern type.
2. The durable transfer roll core of claim 1, wherein the groove comprise a Groove Length from about 1 to about 112 inches.
3. The durable transfer roll core of claim 1, wherein the groove comprise a Groove Length from about 40 to about 55 inches.
4. The durable transfer roll core of claim 1, wherein the roll is selected from a material consisting of plastic, thermoplastic, metal, carbon filaments, thermoplastic resins, and combinations thereof.
5. The durable transfer roll core of claim 1, wherein the durable transfer roll core has a Core Length from about 20 to about 110 inches.
6. The durable transfer roll core of claim 1, wherein the durable transfer roll core has an Outer Core Diameter from about 10 to about 19 inches.
7. The durable transfer roll core of claim 1, wherein the durable transfer roll core has an Inner Core Diameter from about 9 to about 18 inches.
8. The durable transfer roll core of claim 1, wherein the durable transfer roll core has a spiral groove pattern.
9. The durable transfer roll core of claim 1, wherein the durable transfer roll core comprises multiple groove segments.
10. The durable transfer roll core of claim 9, wherein the multiple groove segments are staggered from each other.
11. The durable transfer roll core of claim 1, wherein the durable transfer roll core is cylindrical.
12. The durable transfer roll core of claim 1, wherein the grooves comprise a Groove Width from about 0.01 to about 0.3 inches.
13. The durable transfer roll core of claim 1, wherein the elongate body comprises ridges.

14. The durable transfer roll core of claim 1, wherein a first ridge runs along a first side of the groove.

15. The durable transfer roll core of claim 14, wherein a second ridge runs along a second side of the groove, wherein the second side is opposite the first side of the groove.

16. The durable transfer roll core of claim 15, wherein the first ridge has a ridge height greater than the second ridge.

17. The durable transfer roll core of claim 15, wherein the first ridge has a Ridge Height at least 25% greater than the second ridge.

18. The durable transfer roll core of claim 15, wherein the first ridge has a Ridge Width at least 25% greater than the second ridge.

19. The durable transfer roll core of claim 15, wherein the Ridge Spacing from the first ridge to the second ridge is from about 0.05 to about 0.4 inches.

20. The durable transfer roll core of claim 15, wherein the groove comprises a Groove Depth is from about 0.003 to about 0.1.

21. The durable transfer roll core of claim 1, wherein the roll is selected from a material consisting of high density polyethylene (HDPE), polypropylene random copolymer with modified crystallinity (PP-RCT), polypropylene random copolymer (PP-R), crosslinked polyethylene (PEX), polypropylene, and combinations thereof.

22. The durable transfer roll core of claim 1, wherein the roll comprises high density polyethylene (HDPE).

23. The durable transfer roll core of claim 1, wherein the roll is substantially comprised of high density polyethylene (HDPE).

24. The durable transfer roll core of claim 1, wherein the Groove Angle is from about 10 to about 75 degrees, relative to the longitudinal axis.

25. The durable transfer roll core of claim 1, wherein the Groove Angle is from about 15 to about 60 degrees, relative to the longitudinal axis.

Aspect Example Set 2

1. A durable transfer roll core, comprising:
   an elongate body comprising a groove, the elongate body having a longitudinal axis;
   wherein the groove comprises a Groove Angle from about 0 to about 85 degrees, relative to the longitudinal axis; and
   wherein the groove comprises a Groove Width greater than about 0.01 inches.

2. The durable transfer roll core of claim 1, wherein the groove comprise a Groove Length from about 1 to about 112 inches.

3. The durable transfer roll core of claim 1, wherein the groove comprise a Groove Length from about 40 to about 55 inches.

4. The durable transfer roll core of claim 1, wherein the roll is selected from a material consisting of plastic, thermoplastic, metal, carbon filaments, thermoplastic resins, and combinations thereof.

5. The durable transfer roll core of claim 1, wherein the durable transfer roll core has a Core Length from about 20 to about 110 inches.

6. The durable transfer roll core of claim 1, wherein the durable transfer roll core has an Outer Core Diameter from about 10 to about 19 inches.

7. The durable transfer roll core of claim 1, wherein the durable transfer roll core has an Inner Core Diameter from about 9 to about 18 inches.

8. The durable transfer roll core of claim 1, wherein the durable transfer roll core has a spiral groove pattern.

9. The durable transfer roll core of claim 1, wherein the durable transfer roll core comprises multiple groove segments.

10. The durable transfer roll core of claim 9, wherein the multiple groove segments are staggered from each other.

11. The durable transfer roll core of claim 1, wherein the durable transfer roll core is cylindrical.

12. The durable transfer roll core of claim 1, wherein the Groove Angle is from about 15 to about 60 degrees, relative to the longitudinal axis.

13. The durable transfer roll core of claim 1, wherein the elongate body comprises ridges.

14. The durable transfer roll core of claim 1, wherein a first ridge runs along a first side of the groove.

15. The durable transfer roll core of claim 14, wherein a second ridge runs along a second side of the groove, wherein the second side is opposite the first side of the groove.

16. The durable transfer roll core of claim 15, wherein the first ridge has a ridge height greater than the second ridge.

17. The durable transfer roll core of claim 15, wherein the first ridge has a Ridge Height at least 25% greater than the second ridge.

18. The durable transfer roll core of claim 15, wherein the first ridge has a Ridge Width at least 25% greater than the second ridge.

19. The durable transfer roll core of claim 15, wherein the Ridge Spacing from the first ridge to the second ridge is from about 0.05 to about 0.4 inches.

20. The durable transfer roll core of claim 15, wherein the groove comprises a Groove Depth is from about 0.003 to about 0.1.

21. The durable transfer roll core of claim 1, wherein the roll is selected from a material consisting of high density polyethylene (HDPE), polypropylene random copolymer with modified crystallinity (PP-RCT), polypropylene random copolymer (PP-R), crosslinked polyethylene (PEX), polypropylene, and combinations thereof.

22. The durable transfer roll core of claim 1, wherein the roll comprises high density polyethylene (HDPE).

23. The durable transfer roll core of claim 1, wherein the roll is substantially comprised of high density polyethylene (HDPE).

24. The durable transfer roll core of claim 1, wherein the Groove Angle is from about 10 to about 75 degrees, relative to the longitudinal axis.

Aspect Example Set 3

1. A method of winding a fibrous web comprising a durable transfer roll core, comprising:
   feeding a web onto the durable transfer roll core, the durable transfer roll core comprising an elongate body comprising a groove, wherein the groove comprises a Groove Angle from about 15 to about 90°; and
   winding the web completely around the body of the durable transfer roll core.

2. The method of claim 1, further comprising streaming water at the sheet to assist the feeding and/or winding steps.

3. The method of claim 1, wherein the transfer roll is rotating at a speed of 55 to 1800 rotations/minute.

4. The method of claim 1, wherein the groove comprises a Groove Length from about 1 to about 112 inches.

5. The method of claim 1, wherein the groove comprises a Groove Length from about 40 to about 55 inches.

6. The method of claim 1, wherein the roll is selected from a material consisting of plastic, thermoplastic, metal, carbon filaments, thermoplastic resins, and combinations thereof.

7. The method of claim 1, wherein the durable transfer roll core has a Core Length from about 20 to about 110 inches.

8. The method of claim 1, wherein the durable transfer roll core has an Outer Core Diameter from about 10 to about 19 inches.

9. The method of claim 1, wherein the durable transfer roll core has an Inner Core Diameter from about 9 to about 18 inches.

10. The method of claim 1, wherein the durable transfer roll core has a spiral groove pattern.

11. The method of claim 1, wherein the durable transfer roll core comprises multiple groove segments.

12. The method of claim 11, wherein the multiple groove segments are staggered from each other.

13. The method of claim 1, wherein the durable transfer roll core is cylindrical.

14. The method of claim 1, wherein the groove comprises a Groove Width from about 0.01 to about 0.3 inches.

15. The method of claim 1, wherein the elongate body comprises ridges.

16. The method of claim 1, wherein a first ridge runs along a first side of the groove.

17. The method of claim 16, wherein a second ridge runs along a second side of the groove, wherein the second side is opposite the first side of the groove.

18. The method of claim 17, wherein the first ridge has a ridge height greater than the second ridge.

19. The method of claim 17, wherein the first ridge has a Ridge Height at least 25% greater than the second ridge.

20. The method of claim 17, wherein the first ridge has a Ridge Width at least 25% greater than the second ridge.

21. The method of claim 17, wherein the Ridge Spacing from the first ridge to the second ridge is from about 0.05 to about 0.4 inches.

22. The method of claim 17, wherein the groove comprises a Groove Depth is from about 0.003 to about 0.1.

23. The method of claim 1, wherein the roll is selected from a material consisting of high density polyethylene (HDPE), polypropylene random copolymer with modified crystallinity (PP-RCT), polypropylene random copolymer (PP-R), crosslinked polyethylene (PEX), polypropylene, and combinations thereof.

24. The method of claim 1, wherein the roll comprises high density polyethylene (HDPE).

25. The method of claim 1, wherein the roll is substantially comprised of high density polyethylene (HDPE).

26. The method of claim 1, wherein the Groove Angle is from about 10 to about 75 degrees, relative to the longitudinal axis.

27. The method of claim 1, wherein the Groove Angle is from about 15 to about 60 degrees, relative to the longitudinal axis.

28. The method of claim 1, wherein the feeding and winding steps are done without the use of an adhesive.

Aspect Example Set 4

1. A durable transfer roll core, comprising:
   an elongate body comprising a groove, the elongate body having a longitudinal axis;
   a Core Material Tensile Strength greater than about 1000 lbf/in$^2$ (PSI); and
   an Izod Impact Strength greater than about 1 ft-lbf/in.

2. The durable transfer roll core of claim 1, wherein the groove comprise a Groove Length from about 1 to about 112 inches.

3. The durable transfer roll core of claim 1, wherein the groove comprise a Groove Length from about 40 to about 55 inches.

4. The durable transfer roll core of claim 1, wherein the roll is selected from a material consisting of plastic, thermoplastic, metal, carbon filaments, thermoplastic resins, and combinations thereof.

5. The durable transfer roll core of claim 1, wherein the durable transfer roll core has a Core Length from about 20 to about 110 inches.

6. The durable transfer roll core of claim 1, wherein the durable transfer roll core has an Outer Core Diameter from about 10 to about 19 inches.

7. The durable transfer roll core of claim 1, wherein the durable transfer roll core has an Inner Core Diameter from about 9 to about 18 inches.

8. The durable transfer roll core of claim 1, wherein the durable transfer roll core has a spiral groove pattern.

9. The durable transfer roll core of claim 1, wherein the durable transfer roll core comprises multiple groove segments.

10. The durable transfer roll core of claim 9, wherein the multiple groove segments are staggered from each other.

11. The durable transfer roll core of claim 1, wherein the durable transfer roll core is cylindrical.

12. The durable transfer roll core of claim 1, wherein the grooves comprise a Groove Width from about 0.01 to about 0.3 inches.

13. The durable transfer roll core of claim 1, wherein the elongate body comprises ridges.

14. The durable transfer roll core of claim 1, wherein a first ridge runs along a first side of the groove.

15. The durable transfer roll core of claim 14, wherein a second ridge runs along a second side of the groove, wherein the second side is opposite the first side of the groove.

16. The durable transfer roll core of claim 15, wherein the first ridge has a ridge height greater than the second ridge.

17. The durable transfer roll core of claim 15, wherein the first ridge has a Ridge Height at least 25% greater than the second ridge.

18. The durable transfer roll core of claim 15, wherein the first ridge has a Ridge Width at least 25% greater than the second ridge.

19. The durable transfer roll core of claim 15, wherein the Ridge Spacing from the first ridge to the second ridge is from about 0.05 to about 0.4 inches.

20. The durable transfer roll core of claim 15, wherein the groove comprises a Groove Depth is from about 0.003 to about 0.1.

21. The durable transfer roll core of claim 1, wherein the roll is selected from a material consisting of high density polyethylene (HDPE), polypropylene random copolymer with modified crystallinity (PP-RCT), polypropylene random copolymer (PP-R), crosslinked polyethylene (PEX), polypropylene, and combinations thereof.

22. The durable transfer roll core of claim 1, wherein the roll comprises high density polyethylene (HDPE).

23. The durable transfer roll core of claim 1, wherein the roll is substantially comprised of high density polyethylene (HDPE).

24. The durable transfer roll core of claim 1, wherein the Groove Angle is from about 10 to about 75 degrees, relative to the longitudinal axis.

25. The durable transfer roll core of claim 1, wherein the Groove Angle is from about 15 to about 60 degrees, relative to the longitudinal axis.

Test Methods

If the method does not define a number of replicates to test, the "average" of each of the below described parameters for a roll is achieved by testing each roll within a most-outer package on a retail shelf and taking the average value.

Unless otherwise indicated, all tests described herein including those described under the Definitions section and the following test methods are conducted on samples, fibrous structure samples and/or sanitary tissue product samples and/or handsheets that have been conditioned in a conditioned room at a temperature of 73° F.±4° F. (about 23° C.±2.2° C.) and a relative humidity of 50%±10% for 2 hours prior to the test. Further, all tests are conducted in such conditioned room. Tested samples and felts should be subjected to 73° F.±4° F. (about 23° C.±2.2° C.) and a relative humidity of 50%±10% for 2 hours prior to testing.

"Drop Test" Method

Figure 10:
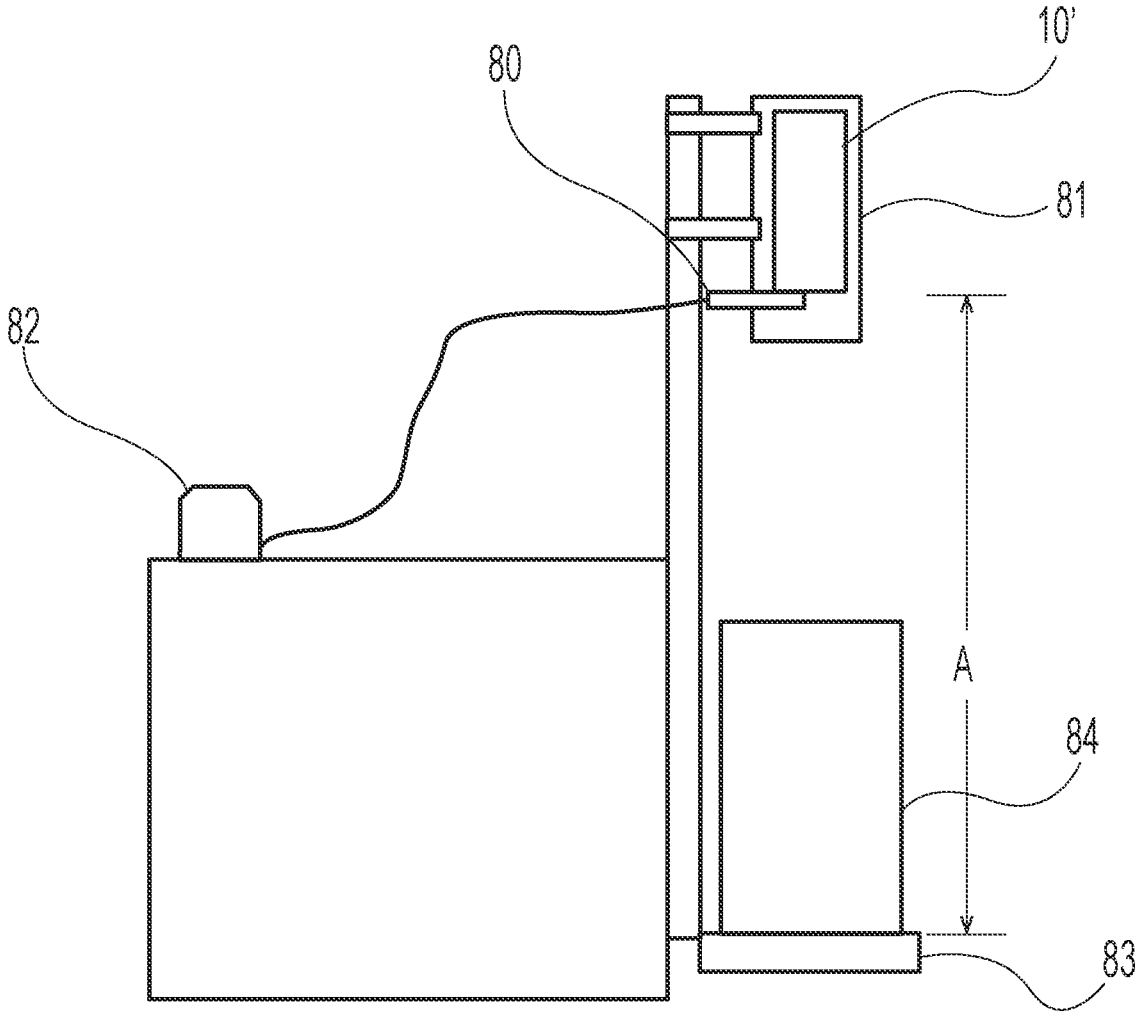
FIG. 10 illustrates the Drop Test Method.

The testing apparatus is set up according the diagram in FIG. 10.

Sample Preparation:

A durable transfer roll core 10 is selected for testing and cut to a length of 22 inches to form a sample 10'. The ends of the sample 10' are inspected to ensure that they are not damaged in any way, otherwise a new sample is to be selected. One of the two ends of the sample 10' is identified as the testing end.

Testing Procedure:

The pneumatic retracting pin 80 is engaged and the sample 10' is placed vertically inside the sample holding drop cylinder 81 with the testing end facing downward. The drop cylinder may have an inner diameter (ID) 3.6" for holding up to 3.5" outer diameter (OD). The pneumatic retracting pin is disengaged by the control switch 82 allowing the sample 10' to free fall and the testing end to strike the surface of the concrete paver stone 83 located directly beneath the sample holding drop cylinder 81. The concrete paver stone 83 may be Home Depot Model 71200, SKU 556211 or equivalent. The distance (A) from the bottom of the sample 10' to the top of the paver stone 83 is 72 inches. After striking the concrete surface the sample 10' is contained by a hollow cylinder 84 to avoid additional damage. The hollow cylinder 84 may have approximately a 16 inch ID and height as needed to contain bounce. This procedure is then repeated on the same sample 10' and same testing end for a total of 100 drops.

Measurements:

Caliper measurements of the OD and Inner Diameter ID are made on testing end of the 10' both prior to testing and following the 100 drops. The measurements are made along the orientation giving the maximum diameter values and are recorded to the nearest 0.001 inches. The percent difference between the pre-test and post-test OD and ID values is calculated and reported to the nearest 0.1%. The ratio of the absolute values of the OD to ID percent difference values is calculated and reported to the nearest 0.1 units.

"Basis Weight" Method:

Basis Weight is measured by preparing one or more samples of a certain area ($m^2$) and weighing the sample(s) of a fibrous structure according to the present disclosure and/or a sanitary toilet tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$).

"Total Dry Tensile Strength" Test Method:

One (1) inch by five (5) inch (2.5 cm×12.7 cm) strips of fibrous structure and/or sanitary toilet tissue product are provided. The strip is placed on an electronic tensile tester Model 1122 commercially available from Instron Corp., Canton, Massachusetts in a conditioned room at a temperature of 73° F.±4° F. (about 28° C.±2.2° C.) and a relative humidity of 50%±10%. The crosshead speed of the tensile tester is 2.0 inches per minute (about 5.1 cm/minute) and the gauge length is 4.0 inches (about 10.2 cm). The Dry Tensile Strength can be measured in any direction by this method. The "Total Dry Tensile Strength" or "TDT" is the special case determined by the arithmetic total of MD and CD tensile strengths of the strips.

"Total Wet Tensile Strength" Test Method:

An electronic tensile tester (Thwing-Albert EJA Materials Tester, Thwing-Albert Instrument Co., 10960 Dutton Rd., Philadelphia, Pa., 19154) is used and operated at a crosshead speed of 4.0 inch (about 10.16 cm) per minute and a gauge length of 1.0 inch (about 2.54 cm), using a strip of a fibrous structure and/or sanitary tissue product of 1 inch wide and a length greater than 3 inches long. The two ends of the strip are placed in the upper jaws of the machine, and the center of the strip is placed around a stainless steel peg (0.5 cm in diameter). After verifying that the strip is bent evenly around the steel peg, the strip is soaked in distilled water at about 20° C. for a soak time of 5 seconds before initiating cross-head movement. The initial result of the test is an array of data in the form load (grams force) versus crosshead displacement (centimeters from starting point).

The sample is tested in two orientations, referred to here as MD (machine direction, i.e., in the same direction as the continuously wound reel and forming fabric) and CD (cross-machine direction, i.e., 90° from MD). The MD and CD wet tensile strengths are determined using the above equipment and the "Total Wet Tensile Strength" or "TWT" is determined by taking the sum of these two values.

"Softness" Test Method:

Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;
2. a grade of plus two is given if X is judged to surely be a little softer than Y, and a grade of minus two is given if Y is judged to surely be a little softer than X;
3. a grade of plus three is given to X if it is judged to be a lot softer than Y, and a grade of minus three is given if Y is judged to be a lot softer than X; and, lastly:
4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

"Lint" Value Test Method:

The amount of lint generated from a finished fibrous structure is determined with a Sutherland Rub Tester. This tester uses a motor to rub a weighted felt 5 times over the finished fibrous structure, while the finished fibrous structure is restrained in a stationary position. This finished fibrous structure can be is referred to throughout this method as the "web". The Hunter Color L value is measured before and after the rub test. The difference between these two Hunter Color L values is then used to calculate a lint value. This lint method is designed to be used with white or substantially white fibrous structures and/or sanitary toilet tissue products. Therefore, if testing of a non-white tissue, such as blue-colored or peach-colored tissue is desired, the same formulation should be used to make a sample without the colored dye, pigment, etc, using bleached kraft pulps.

i. Sample Preparation

Prior to the lint rub testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48 to 52% and within a temperature range of 22° C. to 24° C. This rub testing should also take place within the confines of the constant temperature and humidity room.

The Sutherland Rub Tester may be obtained from Testing Machines, Inc. (Amityville, N.Y., 1701). The web is first prepared by removing and discarding any product which might have been abraded in handling, e.g. on the outside of the roll. For products formed from multiple plies of webs, this test can be used to make a lint measurement on the multi-ply product, or, if the plies can be separated without damaging the specimen, a measurement can be taken on the individual plies making up the product. If a given sample differs from surface to surface, it is necessary to test both surfaces and average the values in order to arrive at a composite lint value. In some cases, products are made from multiple-plies of webs such that the facing-out surfaces are identical, in which case it is only necessary to test one surface. If both surfaces are to be tested, it is necessary to obtain six specimens for testing (Single surface testing only requires three specimens). Each specimen should be folded in half such that the crease is running along the cross direction (CD) of the web sample. For two-surface testing, make up 3 samples with a first surface "out" and 3 with the second-side surface "out". Keep track of which samples are first surface "out" and which are second surface out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5" 6". Puncture two holes into each of the six cards by forcing the cardboard onto the hold down pins of the Sutherland Rub tester.

Center and carefully place each of the 2.5×6" cardboard pieces on top of the six previously folded samples. Make sure the 6" dimension of the cardboard is running parallel to the machine direction (MD) of each of the tissue samples. Center and carefully place each of the cardboard pieces on top of the three previously folded samples. Once again, make sure the 6" dimension of the cardboard is running parallel to the machine direction (MD) of each of the web samples.

Fold one edge of the exposed portion of the web specimen onto the back of the cardboard. Secure this edge to the cardboard with adhesive tape obtained from 3M Inc. (¾" wide Scotch Brand, St. Paul, Minn.). Carefully grasp the other over-hanging tissue edge and snugly fold it over onto the back of the cardboard. While maintaining a snug fit of the web specimen onto the board, tape this second edge to the back of the cardboard. Repeat this procedure for each sample.

Turn over each sample and tape the cross direction edge of the web specimen to the cardboard. One half of the adhesive tape should contact the web specimen while the other half is adhering to the cardboard. Repeat this procedure for each of the samples. If the tissue sample breaks, tears, or becomes frayed at any time during the course of this sample preparation procedure, discard and make up a new sample with a new tissue sample strip.

There will now be 3 first-side surface "out" samples on cardboard and (optionally) 3 second-side surface "out" samples on cardboard.

ii. Felt Preparation

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25"×8.5"×0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single web sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot. Next, rub test the 24 cardboard/felt boards of the new lot and the 24 cardboard/felt boards of the old lot as described below. Make sure the same web lot number is used for each of the 24 samples for the old and new lots. In addition, sampling of the web in the preparation of the cardboard/tissue samples must be done so the new lot of felt and the old lot of felt are exposed to as representative as possible of a tissue sample. Discard any product which might have been damaged or abraded. Next, obtain 48 web samples for the calibration. Place the first sample on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "F" (for "first-side"). Mark the next highest number with the letter "S" (for second-side). Continue marking the samples in this alternating "F"/"S" pattern. Use the "F" samples for first surface "out" lint analyses and the "S" samples for second-side surface "out" lint analyses. There are now a total of 24 samples for the new lot of felt and the old lot of felt. Of this 24, twelve are for first-side surface "out" lint analysis and 12 are for second-side surface "out" lint analysis.

Rub and measure the Hunter Color L values for all 24 samples of the old felt as described below. Record the 12 first-side surface Hunter Color L values for the old felt. Average the 12 values. Record the 12 second-side surface Hunter Color L values for the old felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first-side surface and the delta average difference for the second-side surface and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 first-side surface Hunter Color L values for the new felt. Average the 12 values. Record the 12 second-side surface Hunter Color L values for the new felt. Average the 12 values. Subtract the average initial un-rubbed Hunter Color L felt reading from the average Hunter Color L reading for the first-side surface rubbed samples. This is the delta average difference for the first-side surface samples. Subtract the average initial un-rubbed Hunter Color L felt reading from the average Hunter Color L reading for the second-side surface rubbed samples. This is the delta average difference for the second-side surface samples. Calculate the sum of the delta average difference for the first side surface and the delta average difference for the second-side surface and divide this sum by 2. This is the uncorrected lint value for the new felt.

Take the difference between the corrected Lint Value from the old felt and the uncorrected lint value for the new felt. This difference is the felt correction factor for the new lot of felt. Adding this felt correction factor to the uncorrected lint value for the new felt should be identical to the corrected Lint Value for the old felt. Note that the above procedure implies that the calibration is done with a two-surfaced specimen. If it desirable or necessary to do a felt calibration using a single-surfaced sample, it is satisfactory; however, the total of 24 tests should still be done for each felt.

iii. Care of 4 Pound Weight

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off. When not in use, the weight must be positioned such that the pads are not supporting the full weight of the weight. It is best to store the weight on its side.

iv. Rub Tester Instrument Calibration

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test. Prepare a test specimen on cardboard sample as described above. In addition, prepare a felt on cardboard sample as described above. Both of these samples will be used for calibration of the instrument and will not be used in the acquisition of data for the actual samples.

Place this calibration web sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the web sample and not the web sample itself. The felt must rest flat on the tissue sample and must be in 100% contact with the web surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the web sample at the beginning and end of this test, the tester is calibrated and ready to use. If the total number of strokes is not five or if the end of the felt covered weight closest to the operator is over the actual web sample either at the beginning or end of the test, repeat this calibration procedure until 5 strokes are counted the end of the felt covered weight closest to the operator is situated over the cardboard at the both the start and end of the test. During the actual testing of samples, monitor and observe the stroke count and the starting and stopping point of the felt covered weight. Recalibrate when necessary.

v. Hunter Color Meter Calibration

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary. Place the white standard plate on the sample stage under the instrument port. Release the sample stage and allow the sample plate to be raised beneath the sample port. Using the "L-Y", "a-X", and "b-Z" standardizing knobs, adjust the instrument to read the Standard White Plate Values of "L", "a", and "b" when the "L", "a", and "b" push buttons are depressed in turn.

vi. Measurement of Samples

The first step in the measurement of lint is to measure the Hunter color values of the black felt/cardboard samples prior to being rubbed on the web sample. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit. If a D25D2A head is in use, lower the felt covered cardboard and plate, rotate the felt covered cardboard 90° so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual web sample/cardboard combinations, place the web sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight Hook this weight onto the tester arm and gently place the web sample underneath the weight/felt combination. The end of the weight closest to the operator must be over the cardboard of the web sample and not the web sample itself. The felt must rest flat on the web sample and must be in 100% contact with the web surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the web sample. If torn, discard the felt and web sample and start over. If the web sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples. After all web specimens have been measured, remove and discard all felt. Felts strips are not used again. Cardboards are used until they are bent, torn, limp, or no longer have a smooth surface.

vii. Calculations

Determine the delta L values by subtracting the average initial L reading found for the unused felts from each of the measured values for the first-side surface and second-side surface sides of the sample as follows.

For samples measured on both surfaces, subtract the average initial L reading found for the unused felts from each of the three first-side surface L readings and each of the three second-side surface L readings. Calculate the average delta for the three first-side surface values. Calculate the average delta for the three second-side surface values. Subtract the felt factor from each of these averages. The final results are termed a lint for the first-side surface and a lint for the second-side surface of the web.

By taking the average of the lint value on the first-side surface and the second-side surface, the lint is obtained which is applicable to that particular web or product. In other words, to calculate lint value, Formula 4 below is used:

$$\text{Lint Value} = \frac{\text{Lint Value, first-side} + \text{Lint Value, second-side}}{2} \quad \text{Formula 4}$$

For samples measured only for one surface, subtract the average initial L reading found for the unused felts from each of the three L readings. Calculate the average delta for the three surface values. Subtract the felt factor from this average. The final result is the "Lint" value for that particular web or product.

Color Test Method:

Color-containing surfaces are tested in a dry state and at an ambient humidity of approximately 500%.+−0.2%. Reflectance color is measured using the Hunter Lab LabScan XE reflectance spectrophotometer obtained from Hunter Associates Laboratory of Reston, Va. The spectrophotometer is set to the CIELab color scale and with a D50 illumination. The Observer is set at 10° and the Mode is set at 45/0°. Area View is set to 0.125" and Port Size is set to 0.20" for films; Area View is set to 1.00" and Port Size is set to 1.20" other materials. The spectrophotometer is calibrated prior to sample analysis utilizing the black and white reference tiles supplied from the vendor with the instrument. Calibration is done according to the manufacturer's instructions as set forth in LabScan XE User's Manual, Manual Version 1.1, August 2001, A60-1010-862.

If cleaning is required of the reference tiles or samples, only tissues that do not contain embossing, lotion, or brighteners should be used (e.g., Puffs® tissue). Any sample point on the externally visible surface of the element containing the imparted color to be analyzed should be selected. Sample points are selected so as to be close in perceived color. A single ply of the element is placed over the spectrophotometer's sample port. A single ply, as used within the test method, means that the externally visible surface of the element is not folded. Thus, a single ply of an externally visible surface may include the sampling of a laminate, which itself is comprised of more than one lamina. The sample point comprising the color to be analyzed must be larger than the sample port to ensure accurate measurements. A white tile, as supplied by the manufacturer, is placed behind the externally visible surface. The L*, a*, and b* values are read and recorded. The externally visible surface is removed and repositioned so that a minimum of six readings are obtained for the externally visible surface. If possible (e.g., the size of the imparted color on the element in question does not limit the ability to have six discretely different, nono overlapping sample points), each of the readings is to be performed at a substantially different region on the externally visible surface so that no two sample points overlap. If the size of the imparted color region requires overlapping of sample points, only six samples should be taken with the sample points selected to minimize overlap between any two sample points. The readings are averaged to yield the reported L*, a*, and b* values for a specified color on an externally visible surface of an element.

In calculating the color space volume, V, maximum and minimum L*, a*, and b* values are determined for a particular set of elements to be color matched. The maximum and minimum L*, a*, and b* values are used to calculate V according to Formula 2 presented above.

Absorbency Test Method (Horizontal Full Sheet (HFS)):

The Horizontal Full Sheet (HFS) test method determines the amount of distilled water absorbed and retained by a sanitary toilet tissue product of the present disclosure. This method is performed by first weighing a sample of the sanitary toilet tissue product to be tested (referred to herein as the "Dry Weight of the paper"), then thoroughly wetting the sanitary toilet tissue product, draining the wetted sanitary toilet tissue product in a horizontal position and then reweighing (referred to herein as "Wet Weight of the paper"). The absorptive capacity of the sanitary toilet tissue product is then computed as the amount of water retained in units of grams of water absorbed by the sanitary toilet tissue product. When evaluating different sanitary toilet tissue product samples, the same size of sanitary toilet tissue product is used for all samples tested.

The apparatus for determining the HFS capacity of sanitary toilet tissue product comprises the following: an electronic balance with a sensitivity of at least ±0.01 grams and a minimum capacity of 1200 grams. The balance should be positioned on a balance table and slab to minimize the vibration effects of floor/benchtop weighing. The balance should also have a special balance pan to be able to handle the size of the sanitary toilet tissue product tested (i.e.; a paper sample of about 11 in. (27.9 cm) by 11 in. (27.9 cm)). The balance pan can be made out of a variety of materials. Plexiglass is a common material used.

A sample support rack and sample support cover is also required. Both the rack and cover are comprised of a lightweight metal frame, strung with 0.012 in. (0.305 cm) diameter monofilament so as to form a grid of 0.5 inch squares (1.27 $cm^2$). The size of the support rack and cover is such that the sample size can be conveniently placed between the two.

The HFS test is performed in an environment maintained at 23±1° C. and 50±2% relative humidity. A water reservoir or tub is filled with distilled water at 23±1° C. to a depth of 3 inches (7.6 cm).

The sanitary toilet tissue product to be tested is carefully weighed on the balance to the nearest 0.01 grams. The dry weight of the sample is reported to the nearest 0.01 grams. The empty sample support rack is placed on the balance with the special balance pan described above. The balance is then zeroed (tared). The sample is carefully placed on the sample support rack. The support rack cover is placed on top of the support rack. The sample (now sandwiched between the rack and cover) is submerged in the water reservoir. After the sample has been submerged for 60 seconds, the sample support rack and cover are gently raised out of the reservoir.

The sample, support rack and cover are allowed to drain horizontally for 120±5 seconds, taking care not to excessively shake or vibrate the sample. Next, the rack cover is carefully removed and the wet sample and the support rack are weighed on the previously tared balance. The weight is recorded to the nearest 0.01 g. This is the wet weight of the sample.

The gram per sanitary toilet tissue product sample absorptive capacity of the sample is defined as (Wet Weight of the paper—Dry Weight of the paper).

"Roll Density" Test Method

For this test, the rolled paper product roll is the test sample. Remove all of the test rolled paper product rolls from any packaging and allow them to condition at about 23° C.±2° C. and about 50%±2% relative humidity for 24 hours prior to testing. Rolls with cores that are crushed, bent or damaged should not be tested.

The Roll Density is calculated by dividing the mass of the roll by its volume using the following equation:

$$\text{Roll Density}\left(\frac{\text{g}}{\text{cm}^3}\right) = \frac{\text{Mass (g)}}{\text{Roll Width (cm)}\cdot\pi[\text{Outer Radius (cm)}^2 - \text{Inner Radius (cm)}^2]}$$

Figure 11:
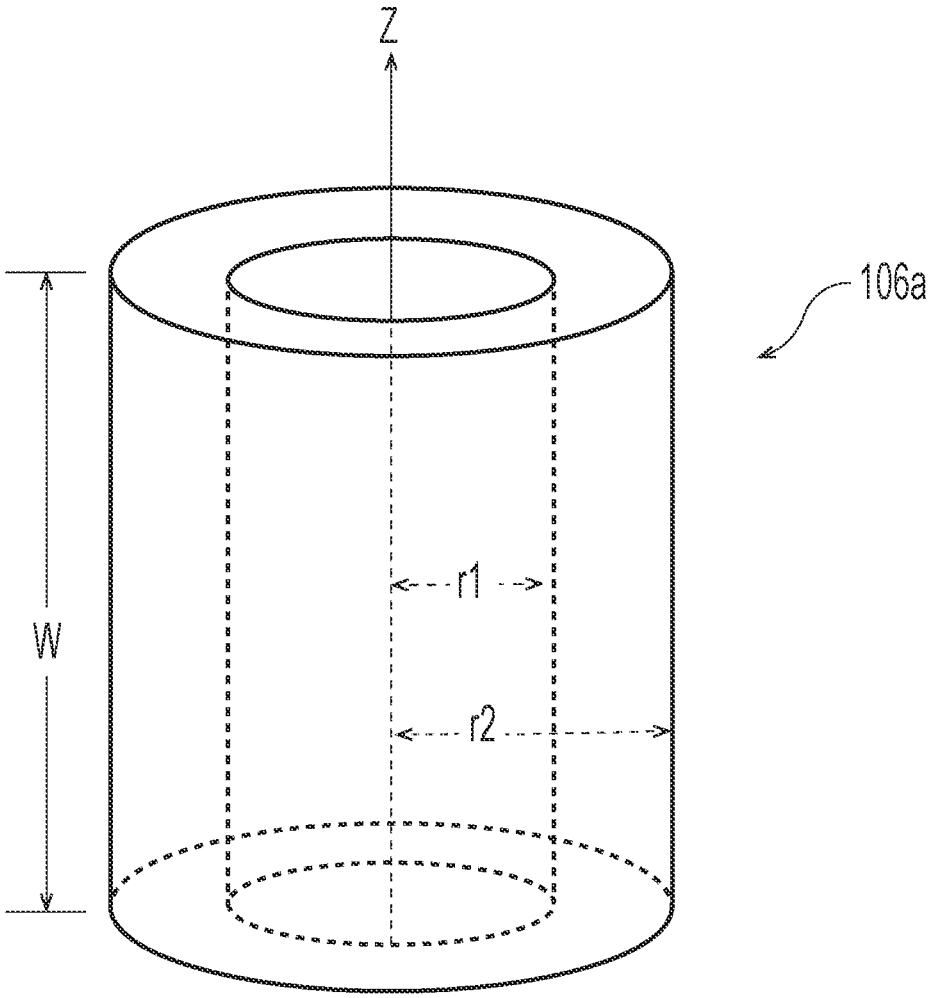
FIG. 11 is a schematic representation of a rolled paper product roll for use in measuring a rolled paper product roll's Roll Density as measured according to the Roll Density Test Method described herein.

FIG. 11 visually describes the measurement of a rolled paper product roll where Z is the center axis of the roll, where the outer radius $r_2$ in units of cm is measured using the Roll Diameter Test Method described herein, the inner radius $r_1$ in units of cm is measured using a caliper tool inside the core, the roll width W is measured using a ruler or tape measure in units of cm and the mass in units of g is the weight of the entire roll including core.

In like fashion analyze a total of ten (10) replicate sample rolls. Calculate the arithmetic mean of the 10 values and report the Roll Density to the nearest 0.001 g/cm$^3$.

"Roll Diameter" Test Method

For this test, the actual rolled paper product roll is the test sample. Remove all of the test rolled paper product rolls from any packaging and allow them to condition at about 23° C.±2° C. and about 50%±2% relative humidity for 24 hours prior to testing. Rolls with cores that are crushed, bent or damaged should not be tested.

The diameter of the test rolled paper product roll is measured directly using a Pi® tape of appropriate length or equivalent precision diameter tape (e.g. an Executive Diameter tape available from Apex Tool Group, LLC, Apex, NC, Model No. W606PD) which converts the circumferential distance into a diameter measurement, so the roll diameter is directly read from the scale. The diameter tape is graduated to 0.01 inch increments. The tape is 0.25 inches wide and is made of flexible metal that conforms to the curvature of the test sanitary tissue product roll but is not elongated under the loading used for this test.

Loosely loop the diameter tape around the circumference of the test rolled paper product roll, placing the tape edges directly adjacent to each other with the surface of the tape lying flat against the test rolled paper product roll. Pull the tape snug against the circumference of the test rolled paper product roll, applying approximately 100 g of force. Wait 3 seconds. At the intersection of the diameter tape, read the diameter aligned with the zero mark of the diameter tape and record as the Roll Diameter to the nearest 0.01 inches. The outer radius of the rolled paper product roll is also calculated from this test method.

In like fashion analyze a total of ten (10) replicate sample rolled paper product rolls. Calculate the arithmetic mean of the 10 values and report the Roll Diameter to the nearest 0.01 inches.

"Roll Firmness" Test Method for Toilet Tissue Roll and Paper Towel Roll Samples

Roll Firmness is measured on a constant rate of extension tensile tester with computer interface (a suitable instrument is the MTS Alliance using Testworks 4.0 Software, as available from MTS Systems Corp., Eden Prairie, MN) using a load cell for which the forces measured are within 10% to 90% of the limit of the cell. The roll product is held horizontally, a cylindrical probe is pressed into the test roll, and the compressive force is measured versus the depth of penetration. All testing is performed in a conditioned room maintained at 23° C.±2° C. and 50%±2% relative humidity.

Figure 12:
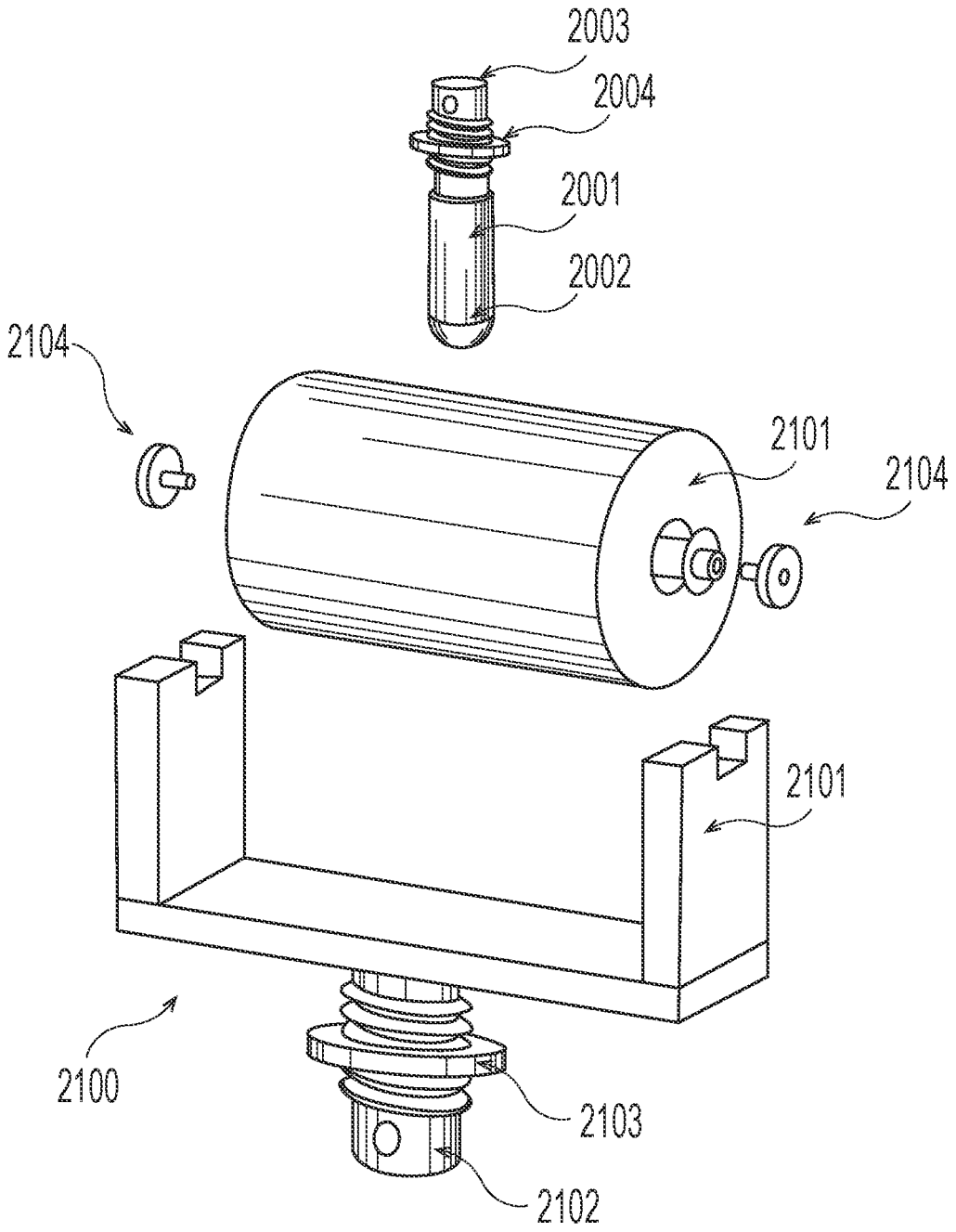
FIG. 12 is a schematic representation of the testing device used in the Roll Firmness measurement.

Referring to FIG. 12, the upper movable fixture 2000 consist of a cylindrical probe 2001 made of machined aluminum with a 19.00±0.05 mm diameter and a length of 38 mm. The end of the cylindrical probe 2002 is hemispheric (radius of 9.50±0.05 mm) with the opposing end 2003 machined to fit the crosshead of the tensile tester. The fixture includes a locking collar 2004 to stabilize the probe and maintain alignment orthogonal to the lower fixture. The lower stationary fixture 2100 is an aluminum fork with vertical prongs 2101 that supports a smooth aluminum sample shaft 2101 in a horizontal position perpendicular to the probe. The lower fixture has a vertical post 2102 machined to fit its base of the tensile tester and also uses a locking collar 2103 to stabilize the fixture orthogonal to the upper fixture.

The sample shaft 2101 has a diameter that is 85% to 95% of the inner diameter of the roll and longer than the width of the roll. The ends of sample shaft are secured on the vertical prongs with a screw cap 2104 to prevent rotation of the shaft during testing. The height of the vertical prongs 2101 should be sufficient to assure that the test roll does not contact the horizontal base of the fork during testing. The horizontal distance between the prongs must exceed the length of the test roll.

Program the tensile tester to perform a compression test, collecting force and crosshead extension data at an acquisition rate of 100 Hz. Lower the crosshead at a rate of 10 mm/min until 5.00 g is detected at the load cell. Set the current crosshead position as the corrected gage length and zero the crosshead position. Begin data collection and lower the crosshead at a rate of 50 mm/min until the force reaches 10 N. Return the crosshead to the original gage length.

Remove all of the test rolls from their packaging and allow them to condition at about 23° C.±2° C. and about 50%±2% relative humidity for 2 hours prior to testing. Rolls with cores that are crushed, bent or damaged should not be tested. Insert sample shaft through the test roll's core and then mount the roll and shaft onto the lower stationary fixture. Secure the sample shaft to the vertical prongs then align the midpoint of the roll's width with the probe. Orient the test roll's tail seal so that it faces upward toward the probe. Rotate the roll 90 degrees toward the operator to align it for the initial compression.

Position the tip of the probe approximately 2 cm above the surface of the sample roll. Zero the crosshead position and load cell and start the tensile program. After the crosshead has returned to its starting position, rotate the roll toward the operator 120 degrees and in like fashion acquire a second measurement on the same sample roll.

From the resulting Force (N) verses Distance (mm) curves, read the penetration at 7.00 N as the Roll Firmness and record to the nearest 0.1 mm. In like fashion analyze a total of ten (10) replicate sample rolls. Calculate the arithmetic mean of the 20 values and report Roll Firmness to the nearest 0.1 mm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of grooving a durable transfer roll core, comprising: loading the durable transfer roll core onto a grooving apparatus; and pulling the durable transfer roll core through the tooling section of the grooving apparatus such that a main surface of the durable transfer roll core is grooved via engagement with one or a plurality of cutting tools of the tooling section of the grooving apparatus further comprising the step of running a cable, rope, or chain through the tooling section and through the durable transfer roll core to pull the durable transfer roll core through the tooling section.

2. The method of claim 1, wherein the cutting tools are selected from the group consisting of a bit, a blade, a rotating tool bit, a knurling tool, a melting tool, a reciprocating or banded saw blade, a rotary saw, a laser, and combinations thereof.

3. The method of claim 1, wherein the cutting tools are placed at different positions around the tooling section.

4. The method of claim 1, wherein the cutting tools surround multiple points around the durable transfer roll core as the durable transfer roll core travels through the tooling section.

5. The method of claim 1, further comprising the step of rotating the durable transfer roll core as it travels through the tooling section.

6. The method of claim 1, further comprising the step of forming ridges disposed at the main surface of the durable transfer roll core.

7. The method of claim 1, wherein at least one cutting tool engages the main surface and wherein at least one cutting tool does not engage the main surface of the durable transfer roll core.

8. The method of claim 1, wherein a spiral groove pattern is formed into the main surface of the durable transfer roll core.

9. The method of claim 1, further comprising the step of unloading the durable transfer roll core form the grooving apparatus.

10. The method of claim 1, wherein the durable transfer roll core rotates as it is pushed or pulled.

11. The method of claim 1, further comprising attaching the cable, rope, or chain to a pulling base that rests against an end edge of the durable transfer roll core.

12. The method of claim 1, wherein loading the durable transfer roll core onto the grooving apparatus comprises positioning the durable transfer roll core on a loading support section of the grooving apparatus.

13. A method of grooving a durable transfer roll core, comprising: surrounding the durable transfer roll core with a grooving apparatus; and moving the grooving apparatus around and/or along the durable transfer roll core via a cable, rope, or chain through the tooling section and through the durable transfer roll core to pull the durable transfer roll core through the tooling section such that a main surface of the durable transfer roll core is grooved via engagement with one or a plurality of cutting tools of the tooling section of the grooving apparatus; and moving a second grooving apparatus around and/or along the durable transfer roll core such that a main surface of the durable transfer roll core is grooved via engagement with one or a plurality of cutting tools of a second tooling section of the second grooving apparatus.

14. The method of claim 13, wherein the durable transfer roll core rotates as the grooving apparatus moves around or along the durable transfer roll core.

15. The method of claim 13, wherein the grooving apparatus rotates around the durable transfer roll core.

16. The method of claim 13, wherein the grooving apparatus moves along the longitudinal axis of the durable transfer roll core.

17. The method of claim 13, wherein the grooving apparatus rotates around and moves along the axis of the durable transfer roll core.

* * * * *